US005182011A

United States Patent [19]

Tsuchitani et al.

[11] Patent Number: 5,182,011

[45] Date of Patent: Jan. 26, 1993

[54] PROCESS FOR PREPARING PITCHES

[75] Inventors: Masatoshi Tsuchitani; Makoto Tamura; Kiyotaka Suzuki; Shuji Okada; Ryoichi Nakajima, all of Ichihara; Sakae Naito, Chiba, all of Japan

[73] Assignee: Maruzen Petrochemical Co., Ltd., Tokyo, Japan

[21] Appl. No.: 616,836

[22] Filed: Nov. 21, 1990

Related U.S. Application Data

[60] Division of Ser. No. 504,723, Apr. 3, 1990, Pat. No. 5,091,072, which is a continuation of Ser. No. 202,126, Jun. 2, 1988, abandoned.

[30] Foreign Application Priority Data

Jun. 18, 1987 [JP] Japan ..... 62-152064
Nov. 13, 1987 [JP] Japan ..... 62-287173

[51] Int. Cl.[5] ..... C10C 1/18; C10C 1/00

[52] U.S. Cl. ..... 208/39; 208/40; 208/44; 208/45

[58] Field of Search ..... 208/39, 40, 44, 45

[56] References Cited

U.S. PATENT DOCUMENTS

| | | | |
|---|---|---|---|
| 4,663,021 | 5/1987 | Arai et al. | 208/39 |
| 4,789,456 | 12/1988 | Tsuchitani et al. | 208/40 |
| 4,820,401 | 4/1989 | Tsuchitani et al. | 208/44 |
| 4,832,820 | 5/1989 | Romine | 208/39 |
| 4,925,547 | 5/1990 | Tsuchitani et al. | 208/39 |

*Primary Examiner*—Helane Myers
*Attorney, Agent, or Firm*—Melvin I. Stoltz

[57] ABSTRACT

Commercially attractive continuous processes for the preparation of mesophase pitches for manufacturing high-performance carbon fibers are disclosed. One feature resides in that conversion of a pitch into a mesophase pitch is conducted continuously by using a unique continuous dispersion-heat-treating apparatus. The other feature resides in that the raw material for hydrogenation treatment which is a pretreatment preceeding to the final heat treatment for the production of a mesophase pitch, is prepared by using a heavy oil or pitch having substantially no BTX-insoluble material as the starting raw material, subjecting the raw material to a simple four-step treatment of (1) a continuous heat treatment in a tubular heater, (2) a distillation operation, (3) a BTX-solvent extraction and (4) a distillation operation; while recycling a soluble component obtained in the step (4) to the heat treatment of step (1) and recovering a BTX-solvent insoluble component formed in step (3) as the material for the hydrogenation treatment. This feature can provide a significant increase in the yield of a mesophase pitch. Furthermore, unexpectedly, the recycle of the soluble component into the heat treatment of step (1) is helpful to improve the characteristics of the ultimate products, i.e., carbon fibers or graphite fibers. Combination of the first and the second features, of course, can provide a better commercial success. In fact, the process of the present invention can provide a carbon fiber having a tensile strength of more than 300 $kg/mm^2$ and a graphite fiber having a tensile strength of more than 400 $kg/mm^2$ and a modulus of elasticity of more than 60 $ton/mm^2$. Processes with minor modifications to the above are also disclosed.

29 Claims, 2 Drawing Sheets

PROCESS FOR PREPARING PITCHES

This application is a division of application Ser. No. 07/504,723, filed Apr. 3,1990, now abandoned, which is a continuation of U.S. Ser. No. 07/202,126, filed Jun. 2, 1988 now abandoned.

BACKGROUND OF THE INVENTION 1. Field of the Invention

The present invention relates to a continuous process for preparing a pitch with a high softening point, and is particularly directed to a suitable process for preparing a spinning pitch used for the production of carbon fibers, and also relates to a process for efficiently preparing a homogeneous mesophase pitch with a low softening point, which is suitable for producing pitch-based high-performance carbon fibers.

As stated above, main object of the present invention is to provide a continuous process for the production of mesophase pitches for manufacturing high-performance carbon fibers, but the present invention is not limited thereto. For example, the hydrogenated pitch suitably used to achieve the main object can also provide excellent mesophase pitches in batchwise operations, and further, the apparatus for heat treatment of pitch used in the present invention is not only useful for the production of mesophase pitches but also useful for heat treatment of any type of pitches. When taking into account of circumstances above, one of the embodiments of the present invention can be summarized as follows:

That is, the first embodiment relates to a continuous process for efficiently preparing a pitch with a high softening point by dispersing a heavy oil or pitch in a gas stream of an inert gas or superheated vapor as fine oil droplets at 350°-500° C. under a reduced or normal pressure, and bringing the dispersed fine oil droplets into contact with an inert gas or superheated vapor, thereby effecting elimination of light fractions and a proper degree of thermal polymerization. The second embodiment of the present invention can be summarized as follows:

That is, the second embodiment relates to a process for preparing a mesophase pitch for the production of high-performance carbon fibers which comprises: using, as a raw material, a heavy oil or pitch of coal or petroleum origin which is substantially free from a material insoluble in a monocyclic aromatic hydrocarbon solvent; and subjecting said raw material to a successive four-step treatment comprising a first step of heat-treating said raw material in a tubular heater under a specific condition, thus newly producing a component insoluble in a monocyclic aromatic hydrocarbon solvent without producing a quinoline-insoluble component, a second step of distilling or flashing said heat-treated material obtained in the first step to remove a portion of light fractions thus obtaining a thermal-cracked heavy component having specific properties, a third step of recovering from this thermal-cracked heavy component, the component insoluble in a monocyclic aromatic hydrocarbon solvent or other solvent having the dissolving ability equivalent to the monocyclic aromatic hydrocarbon solvent as a high-molecular-weight bituminous material, and a fourth step of obtaining a soluble component by distilling off the solvent from the mother liquor separated in the third step; while recycling whole or a portion of said soluble component produced in the fourth step to the first step; hydrogenating said high-molecular-weight bituminous material obtained in the third step by heat-treating the same in the presence of a hydrogen-donating solvent, thereby obtaining a hydrotreated liquid, or further removing the solvent to obtain a hydrogenated pitch; and heat-treating the hydrotreated liquid or hydrogenated pitch by dispersing it as fine oil droplets under a specific condition to obtain a mesophase pitch.

The third embodiment of the present invention can be drawn up by omitting the requirement of the fourth step, and omitting also the requirement for recirculation of the soluble component to the first step stipulated in the second embodiment just mentioned above.

The fourth embodiment of the present invention can be drawn up by omitting the requirement for conducting the final heat treatment by dispersion to form fine oil droplets stipulated in the second embodiment mentioned before.

All of these embodiments are, of course, within the scope of the present invention.

Pitches with a high softening point are used as a binder for preparing carbon products or the like. The pitch with a high softening point prepared by the process according to the present invention is particularly suitable for use as a raw material for preparing carbon fibers, since light fractions have efficiently been eliminated from the pitch.

According to the process of the present invention, a homogeneous mesophase pitch with a low softening point can be prepared efficiently and constantly.

Carbon fibers are classified into PAN-based carbon fibers prepared from polyacrylonitrile (PAN) and pitch-based carbon fibers prepared from pitches with a high softening point. The pitch-based carbon fibers are further grouped into general-purpose carbon fibers (GP carbon fibers) with a lower strength and modulus of elasticity and are used as high temperature insulating materials or the like, and high-performance carbon fibers (HP carbon fibers) with a higher strength and modulus of elasticity and are used as structural materials for aircraft, industrial robots, sporting goods, and the like. The characteristics of spinning pitches used for preparing these two pitch-based carbon fibers, GP and HP carbon fibers, are quite different. The spinning pitches used for the GP carbon fibers are the so-called isotropic pitches, which exhibit complete isotropy when observed by a polarizing microscope. The spinning pitches used for the HP carbon fibers are the so-called mesophase pitches which contain as major components mesophases, exhibiting optical anisotropy. These two types of pitches are not only quite different texturally from each other when observed by a microscope, but also largely differ in softening points and in solvent-insoluble contents. There are certain characteristics, however, which these two types of pitches must possess in common. Such characteristics include the absence of light fractions which vaporize at a spinning temperature and cause bubbles to form in the pitch, and the absence of solid components or excessively highly polymerized compounds which do not homogeneously melt at the spinning temperature. Generally, the preparation of spinning pitches for preparing HP carbon fibers, i.e., mesophase pitches, requires a more sophisticated technology than does the preparation of spinning pitches for preparing GP carbon fibers. This is due to the higher softening point of the mesophase pitches, requiring a higher spinning temperature, where the presence of a small amount of light fractions greatly affects the characteristics of the product carbon fibers in an adverse way. Another problem is that the mesophase pitches require heat treatment in the preparation process for converting the pitch texture into the mesophase. This heat treatment tends to produce solid materials or excessively polymerized compounds which do not melt at the spinning temperature. This also causes the characteristics of the produced carbon fibers to be greatly impaired. Thus, the production of a spinning pitch for the HP carbon fibers requires more sophisticated technology than the production of spinning pitches for preparing GP carbon fibers.

The process according to the present invention can be applicable for preparing either of the spinning pitches for GP and HP carbon fiber production. However, the process is especially suitable for the preparation of spinning pitches for producing HP carbon fibers.

2. Description of the Prior Art

Hitherto, a major source of the high-performance carbon fiber has been PAN-based carbon fibers which are produced by spinning PAN, rendering them infusible in an oxidizing atmosphere, and carbonizing or graphitizing them in an inert gas atmosphere. In recent years, however, processes were found to produce from pitches high-performance carbon fibers which are competitive or even superior to the PAN-based carbon fibers in their properties. Since pitches are an inexpensive raw material, the findings have drawn a great attention as a route for preparing high-performance carbon fibers at a low cost.

Production of pitches from heavy oils by processes including distillation, heat treatment, hydrogenation, and the like, are known from early in the art. Heavy oils used include coal tar, those by-produced in the cracking of naphtha (naphtha tar), in the cracking of gas oil (pyrolysis tar) or in the catalytic cracking processes (decant oil), liquefied coals, or topping or vacuum residues. The pitches produced by these processes are widely used for the preparation of carbon products.

In preparing the high-performance carbon fibers from a pitch, the spinning pitch must be a so-called mesophase pitch which contains, as a major component, the substance exhibiting an optically anisotropic mesophase when examined on a polarizing microscope.

This mesophase is a kind of liquid crystals which is formed when a heavy oil or a pitch is heat-treated, and its optically anisotropic character is due to an agglomerated layered structure of thermally polymerized planar aromatic molecules. When such mesophase is subjected to melt spinning, the planar aromatic molecules are aligned to the direction of the fiber axis due to the stress exerted to the melt as it passes through a nozzle hole, and this oriented structure can be kept without being disrupted throughout subsequent steps to render it infusible and carbonization steps, and therefore, high-performance carbon fibers having good orientation can be obtained. On the contrary, when an isotropic pitch containing no mesophase is used, such orientation does not occur sufficiently by the stress when molten pitch passes through a nozzle hoe because of the insufficient development of planar structure of molecules, and this renders the fibers poorly oriented and produces a carbon fiber with a lower strength, even if it is rendered infusible and carbonized. Therefore, a number of known processes for the manufacture of a high-performance carbon fiber from pitches are directed to the process for preparing mesophase pitches spinnable into the fiber.

In the decade of 1965–1974, the mesophase was considered as equivalent of the substance insoluble in polar solvents such as quinoline and pyridine because of the fact that the mesophase produced by the heat treatment was insoluble in such polar solvents. Subsequent studies on the mesophase, however, have unveiled the fact that the portion of the pitch which exhibits anisotropy under a polarizing microscope is not necessarily the same substances with polar solvent insoluble substances, and further that the mesophase is composed of both polar solvent soluble and insoluble components. It is thus common nowadays to define the term "mesophase" as "a portion exhibiting optical anisotropy when examined on a polarizing microscope". Furthermore, it is genera to express the mesophase content by the ratio of areas exhibiting optical anisotropy and isotropy when a pitch is examined on a polarizing microscope.

The mesophase content as determined according to this definition represents a property of a pitch having a great significance on its suitability as well as the characteristics of the carbon fiber made therefrom. Japanese Patent Laid-open No. Sho 54(1979)-55625 describes a pitch containing essentially 100% of mesophase, and states that it is desirable to reduce an isotropic portion as much as possible, because the presence of isotropic portion interferes with the spinning operation. The reason is that a pitch with a smaller mesophase content tends to separate into two phases in a molten state due to the lower viscosity of the isotropic portion than the anisotropic mesophase. When one tries, however, to increase the mesophase content of a pitch, the softening point and the viscosity become significantly high, making it difficult to spin the pitch. Thus, the most important problem in a process for preparing a high-performance carbon fiber from a mesophase pitch resides in the fact that a significantly high temperature is necessary to use at the spinning stage because of the high softening point of the pitch. Spinning at a temperature of above 350° C. involves such problems as cutting off of fibers and decrease of the fiber strength resulting from decomposition, deterioration, or thermal polymerization of the pitch in the spinning facility. Since a temperature which is 20°–40° C. higher than the Mettler method softening point of the pitch is generally required for the spinning, the softening point of the mesophase pitch must be below 320° C. in order to keep the spinning temperature lower than 350° C. The process described in Japanese Patent Laid-open Sho 54(1979)-55625 is a process for heat-treating a pitch at a relatively low temperature for a long period of time, and as described in the specification, the pitch obtained has a considerably high softening point of 330°–350° C., and therefore, spinning is carried out at a high temperature of above 350° C.

Japanese patent Laid-open No. Sho 58(1983)-154792 discloses a quinoline-soluble mesophase, and states that the content of the quinoline-soluble mesophase in a pitch must be higher than a specific amount because the quinoline or pyridine insoluble mesophase raises the softening point of a mesophase pitch. There is no detailed description in this laid-opened publication about the differences between the quinoline-insoluble and soluble mesophase, but it may easily be understood that a highly polymerized substance with an extraordinarily high molecular weight would be insoluble in quinoline, and therefore, in other words, an attempt for preparing a pitch with a high quinoline-soluble content would lead to an effort to reduce the content of such extraordinarily high molecular weight components and to prepare a homogeneous pitch having a narrow molecular weight distribution. The process of Japanese Patent Laid-open No. Sho 58(1983)-154792 comprises heat-treating a pitch having a specific range of aromatic hydrogen content. Although more than 40% of the spinning pitch obtained therein is quinoline-soluble mesophase, there is still remaining a large amount of quinoline-insoluble component, and therefore, spinning is conducted at a considerably high temperature.

It is easy to reduce the quinoline-insoluble component itself by, for example, employing a mild heat-treating condition. But, this leads to a significant decrease in the mesophase content and an increase in low molecular-weight components which are soluble in a solvent such as xylene. This low-molecular-weight component which is soluble in xylene and the like will have an adverse effect to the orientation of the fiber while spinning, and evaporate at the spinning temperature giving a cause of the fiber cut off. Therefore, in order to prepare a spinning pitch with an excellent quality, it is not sufficient merely to decrease the content of exceedingly high-molecular-weight components which are insoluble in quinoline. Low-molecular-weight components which are soluble in xylene and the like must also be decreased, so as to make the pitch homogeneous and increase the content of intermediate components.

Various processes have been proposed other than those described above for preparing such homogeneous pitches. In one of the processes, an isotropic pitch is extracted by a solvent and the insoluble components are heat treated at a temperature of 230°–400° C. (Japanese Patent Laid-open No. Sho 54(1979)-160427). Other processes comprise hydrogenation of an isotropic pitch in the presence of a hydrogen-donating solvent, followed by a heat treatment (Japanese Patent Laid-open Nos. Sho 58(1983)-214531 and Sho 58(1983)-196292). Still other process employs a repetition of a heat treatment on a pitch which was obtained by removing mesophase from a heat treated isotropic pitch (Japanese Patent Laid-open No. Sho 58(1983)-136835). Further, still other process can give a pitch containing 20–80% of mesophase by a heat treatment, and then recover the mesophase by precipitation (Japanese patent Laid-open No. Sho 57(1982)-119984). The pitches prepared by these processes, however, are not necessarily satisfactory, i.e., some pitches have a sufficiently high mesophase content but not sufficiently low softening point, some have a sufficiently low softening point but do not have a sufficiently high mesophase content, some pitches have both a low softening point and a high mesophase content but contains a large amount of significantly high-molecular-weight mesophase which is insoluble in quinoline and the like and cannot be deemed as homogeneous pitch. None of these processes can provide pitches satisfying the following four requirements at the same time, that is: (1) a low softening point, (2) a high mesophase content, (3) a low quinoline-insoluble content, and (4) a low xylene-soluble contenent.

As a process for resolving these problems, Japanese Patent Laid-open No. Sho 61(1986)-138721 proposes a process for preparing a mesophase pitch comprising, subjecting a coal tar or heat-treated material of the same to a solvent extraction to obtain insoluble components, and hydrogenating and further heat-treating the insoluble components. The pitch produced by this process is a homogeneous pitch with a quinoline-insoluble content of below 20% and a mesophase content of above 90%. However, the strength of carbon fibers prepared from this pitch is not necessarily high enough according to the examples. The problem with this process resides in the fact that the solvent insoluble components existing in the starting material, coal tar, are not prepared for the purpose of producing spinning pitch for carbon fibers production. When solvent insoluble components which have originally existed in a raw material, coal tar or pitch, are separated and used as a spinning pitch, the properties of the spinning pitch or the characteristics of the carbon fibers are dependent upon the processes through which this raw material has been derived.

When a spinning pitch for carbon fibers production is prepared, not only the pitch must satisfy the aforementioned four characteristics by itself, but also it must produce carbon fibers with good characteristics.

Beside above-mentioned Japanese Patent Laid-open Nos. Sho 58(1983)-214531, Sho 58(1983)-196292, and Sho 61(1986)-138721, there are many processes proposed for effecting heat treatment after hydrogenation of a bituminous material such as pitches. These processes are effective in preparing spinning pitches with a low softening point. However, the most of these proposed processes take it for granted to use commercially available pitches or solvent-insoluble components contained therein, as they are, as a raw material for hydrogenation treatment. Since the raw material has not been specially prepared for the purpose of a spinning pitch production, the properties of the spinning pitch or the characteristics of the carbon fibers inevitably dependent upon the properties of the raw material. Therefore, there exists a desire for the development of a process which is capable of stably producing spinning pitches from which any possible factors of the fluctuation in raw material properties have been removed. The use of the process for increasing the yield of the solvent-insoluble components by the heat treatment of coal tar pitch involves the heat treatment of the solvent-ionsoluble components which have originally existed in the coal tar pitch, thus causing the formation of undesirable high-plymerized materials such as quinoline-insoluble components, and the like. If the solvent-insoluble components derived from such heat-treated materials containing the undesirable high-polymerized substances are used as a raw material for hydrogenation treatment, a great amount of solid materials must be filtered for separation after the solvent insoluble components have been hydrogenated. This procedure of filtration and separation of the insoluble component contained in the hydrogenation solvent cannot always be performed effectively. There are various potential problems for scaling-up of this procedure, such as a slow speed of the filtration, clogging of the filter which makes it impossible to reuse the filter, and the like. Furthermore, if a raw material which may produce a large amount of insoluble component is used for this hydrogenation treatment, it is impossible to employ an efficient continuous process, such as the use of a tubular heater. Instead, the use of an inefficient batch-type treatment process is unavoidable.

A method of collecting solvent-insoluble components from coal tar pitch is described in the text of Japanese Patent Laid-open No. Sho 61(1986)-138721 in which it is stated that "Preferably, it can be performed using 5–20 times of solvent, at the boiling point or at a temperature near the boiling point, and for about 3–12 hr.". Thus the processes heretofore proposed are not necessarily efficient. Therefore, thorough consideration must be given also to the procedure for collecting insoluble components when a solvent-insoluble component is used as a raw material.

Accordingly, there is a desire for the development of a process for preparing a spinning pitch for the production of pitch-based high-performance carbon fibers, which satisfies the requirements for both the properties of the spinning mesophase pitch and the characteristics of the carbon fibers at the same time. Furthermore, the development of a process which is efficient and stable, and adapted to the scale-up, is desired.

We have already proposed processes for preparing pitches for the production of carbon fibers, i.e., Japanese Patent Laid-opens No. Sho 61(1986)-103989, No. Sho 61(1986)-238885 and No. Sho 62(1987)-277491. Although they are useful processes, they are still not sufficient enough to satisfy all of the requirements for the preparation of high-performance carbon fibers.

When the disclosures given in prior art are examined from another point of view, following facts can be recognized:

Examples of processes for preparation of pitches for use as raw materials for the production of carbon fibers are a process using a pitch obtained by hydrogenation or heat treatment of a specific type of polynuclear aromatic compounds (Japanese Patent publication No. Sho 45(1970)-28013 and Japanese Patent Publication No. Sho 49(1974)-8634); a process comprising treating a petroleum-derived pitch-like material in the presence of a Lewis acid, followed by heat treatment (Japanese Patent Publication No. Sho 53(1978)-7533); a process comprising heat-treating a pitch with a specific range of aromatic hydrogen content (Japanese patent Laid-open No. Sho 58(1983)-154792); a process comprising hydrogenating an isotropic pitch in the presence of a hydrogen-donating solvent, followed by heat treatment (Japanese Patent Laid-open No. Sho 58(1983)-214531) and Japanese Patent Laid-open No. Sho 58(1983)-196292); a process comprising heat-treating an isotropic pitch, separating and removing the produced mesophase, and heat-treating the pitch thus obtained (Japanese patent Laid-open No. Sho 58(1983)-136835 and Japanese patent Laid-open No. Sho 59(1984)-38280); and the like. The problem common to these processes is that the processes all utilize a batch-type heat treatment in their last step. As mentioned above, the production of spinning pitches requires the effective elimination of light fractions and a moderate degree of thermal polymerization. These must be done, however, under strictly controlled conditions in order to produce pitches which do not contain an unacceptable amount of infusible solid materials, and are free from light fractions which vaporize, or materials which decompose at the spinning temperature. The aforementioned heat treatment for the production of the spinning pitches is generally effected at a high temperature in the range of 350°-500° C. Carrying out this heat treatment using a batch system in an industrial-scale manufacturing facility involves difficulties in strictly controlling the operating temperature, pressure, time of treatment, and the like. Such difficulties increase as the amount to be treated per batch increases, and inadequate operations due to these difficulties tend to bring about undesirable results such as the formation of solid materials, insufficient elimination of light fractions, as well as fluctuation of the product properties between batches.

For these reasons, there has been a need for the development of continuous processes for preparing spinning pitches. One of the processes proposed comprises reducing and cracking a pitch like material using a reducing solvent, and bringing the cracked material flowing down as a thin film into contact with an inert gas (Japanese Patent Laid-open No. Sho 59(1984)-88922). Another process proposes that a carbonaceous pitch be introduced into a thin-film evaporator, and be treated under specific conditions in the presence of an inert gas (Japanese Patent Laid-open No. Sho 60(1985)-238387). One feature common to these processes is to develop a thin film of pitches to enlarge their surface area so as to promote the rate of light fractions vaporization. Although these continuous processes may bring about better efficiency than those of batch processes, they present problems which remain to be resolved. When a pitch flows down by virtue of its weight, for example, as in the process disclosed in Japanese patent Laid-open No. Sho 59(1984)-88922, it does not form a uniform film if the flow amount is not sufficiently large. Rather, the pitch tends to flow down along a specific part of the wall (channeling), because the flow rate range, which allows the pitch film to develop evenly across the wall, is much limited. Thus, it is extremely difficult to develop a uniform pitch film. If the pitch to be treated in this process is a low-viscosity fluid, it is possible to develop what is known as the ideal piston flow. However, when the fluid has a high viscosity as in the case where spinning pitches are to be prepared, a uniform piston flow cannot always be developed. This produces fluctuations in the residence time of the material in the treatment zone, giving a wider residence time distribution. This wide residence time distribution, in turn, becomes the cause of fluctuations in the light fractions contents in the produced pitch, and also of fluctuations in the degree of thermal polymerization, which results in a heterogeneous pitch Such heterogeneous pitches pose difficulties in the spinning operations required in the production of carbon fibers, and produces carbon fibers with extremely impaired properties, and which are thus unsuitable for use as raw materials for carbon fibers. In the process in which the downflow movement of a pitch relies only on its gravity, the residence time is dependent on the length of the wall in the vertical direction and on the viscosity of the pitch, making it difficult to control the residence time. Because of these reasons, Japanese Patent Laid-open No. Sho 59(1984)-88922 employs, in its examples, the means for providing a longer average residence time through the provision of a pump for circulating the pitch to be treated, and an overhead storage which permits the fluid to reside over a prolonged period of time. Since the pitch is continuously being taken out from the process as a product while being circulated, it is evident that the produced spinning pitch is a mixture of the pitches treated for different periods of time. Spinning pitches must be very homogeneous, as can be readily understood, because of the fact that they are to be spun into a fiber having a very small diameter of the micron order. Thus, a process which produces fluctuation in the treatment time is not preferable. The major reason for using batch systems in the heat treatment which is the last step in the above-mentioned various processes for the preparation of spinning pitches from heavy oils is to prevent this fluctuation in the treatment time.

In order to resolve this problem, the process of Japanese Patent Laid-open No. Sho 60(1985)-238387, which uses a thin-film evaporator, was proposed This process produces a thin fim of the pitch on the treatment vessel wal by mechanically forcing the pitch against the wall using a rotating blade. The thickness of the film can be controlled by changing the clearance between the blade and the vessel wall. This process, however, requires a large wall area onto which a thin film of the pitch is developed, which inevitably results in an increased production facility size as well as less economical production. More specifically, in order to shorten the treatment time for producing a specific amount of pitch exhibiting a desired quality, the pitch film must be as thin as possible to provide a larger area for evaporation. This leads to the need for a larger facility. If the thickness of the pitch film is increased to provide a longer residence time for the treatment, the rate of evaporation is retarded, and the light fractions can be eliminated only insufficiently. Thus, at all events, the process requires a large facility for achieving the satisfactory elimination of the light fractions. Since the Japanese Patent Laid-open No. Sho 60(1985)-238387 does not describe the details of the thin-film evaporator nor the amount of pitches to be treated, the details involved cannot be discussed here. It can be readily understood, however, that the process must involve feeding of a small amount of pitch to a facility with an unduly large vaporization area in order to provide an average residence time of 30 minutes at almost zero clearance, i.e., almost zero film thickness.

Using a higher temperature for the treatment is another way of shortening the treatment time. The use of a high temperature, however, gives rise to coking of the pitch on the wall and to formation of a solid fim. The formation of cokes on the wall during a continuous operation can be the immediate cause of the changes in the clearance between the rotating blade and the wall, and thus changes the thickness of the pitch film. In the worst case, it interrupts the rotating movement of the bade. Raising the temperature to shorten the treatment time is, therefore, permitted only in a limited range. Another major problem in developing a pitch onto the wall of the vessel is the formation of cokes on the wall. If the film thickness changes from moment to moment during continuous operation due to coke formation, it is impossible to produce a homogeneous pitch over a long period of time. The problem is attributable to the situation specific to the preparation of pitches, especially spinning pitches for carbon fiber production which requires the heat treatment at a relatively high temperature in the range of 350°-500° C. for eliminating light fractions and effecting a moderate thermal polymerization, but requires, on the other hand, preventing the coke formation due to excessive thermal polymerization. This kind of situation does not exist in the handling of usual polymers. Simply eliminating solvents used and unreacted materials from such polymers merely requires a conventional thin-film evaporator, a current industry-wide practice without problems. The processes or facilities industrially utilized for eliminating light fractions at a relatively low temperature of below 350° C. are not always effectively applied to the preparation of pitches.

As mentioned above, the preparation of pitches, especially spinning pitches for carbon fiber production, requires at the last stage the efficient elimination of light fractions, effecting a moderate thermal polymerization of the components, and depressing the coke formation. These three requirements have been met using the conventionally utilized continuous processes coupled only with the provision of a longer time for the treatment by circulating pitches or enlarging the treating facility. In view of this situation, a strong desire has remained for the development of an efficient and effective process for continuous treatment of pitches.

SUMMARY OF THE INVENTION

The present invention provides a process for efficiently and continuously carrying out the heat treatment in the pitch preparation process, especially of spinning pitches used for the production of carbon fibers.

That is, according to the present invention, an efficient and effective process is provided by which the control of the treatment conditions is performed more strictly and easily than in the conventional batch processes to produce homogeneous pitches. Furthermore, the process of the present invention can satisfy the aforementioned three requirements at the same time, i.e., it can efficiently eliminate light fractions, effect a moderate thermal polymerization, and depress the coke formation due to excessive thermal polymerization. Moreover, the process makes it possible to shorten the treatment time and to use a simplified, smaller manufacturing facility. These problems represent those which could not be previously resolved by the conventional continuous treating processes utilizing the thin-film forming methods.

Further, the present invention provides efficient processes for the preparation of mesophase pitches from a heavy oil or pitch of coal or petroleum origin and the hydrogenated pitches obtained in the course of these processes are particularly suitable for use as the raw materials when conducting the process of the first embodiment of the present invention.

That is, taking a number of the above-mentioned requirements discussed about prior arts into consideration, we conducted extensive studies about a process for the preparation of a mesophase pitch for high-performance carbon fibers production. As a result, we previously found a process for preparing a mesophase pitch which satisfies the aforementioned four characteristics at the same time. According to that process, materials insoluble in a monocyclic aromatic hydrocarbon solvent, which are contained in a starting raw material or which are easily produced when the starting raw material is subjected to distillation or heat treatment, are removed in advance to obtain a refined heavy oil or pitch. This refined heavy oil or pitch is subjected to a heat treatment under a specific conditions, to recover components insoluble in a monocyclic aromatic hydrocarbon solvent, which are newly formed by the heat treatment. The recovered insoluble components are hydrogenated by the heat treatment in the presence of a hydrogen-donating solvent, followed by further heat treatment under a reduced pressure or while blowing an inert gas, to yield a mesophase pitch. An application for patent was filed concerning that process (Japanese Patent Laid-open No. Sho 62(1987)-270685). That is, we have proposed a process for preparing a mesophase pitch from a high-molecular-weight bituminous material by hydrogenation thereof under heating in the presence of a hydrogen-donating solvent, and a successive heat treatment of the thus hydrogenated bituminous material, characterized in that said high-molecular-weight bituminous material is produced through the following steps: a step of producing a refined heavy oil or pitch which comprises adding, to a heavy oil or pitch of petroleum or coal origin, a predetermined amount of monocyclic aromatic hydrocarbon solvent, separating and removing the insoluble materials thus formed by centrifugation or filtration, and then removing the monocyclic aromatic hydrocarbon solvent added by a distillation; a step of subjecting the refined heavy oil or pitch to a heat treatment in a tubular heater at a predetermined condition under an increased pressure in the absence or presence of an aromatic oil in an amount of 0–1 times of the refined heavy oil or pitch, the aromatic oil having a boiling range of 200°–450° C. and being substantially free of components forming insolubles in a monocyclic aromatic hydrocarbon solvent at the heat treatment in the tubular heater; and a step adding to the thus heat-treated material, a predetermined amount of a monocyclic aromatic hydrocarbon solvent, and recovering the newly formed insoluble component as the high molecular-weight bituminous material by centrifugation or filtration. A homogeneous pitch with a low softening point can be prepared according to that process.

However, according to that process a refined heavy oil or pitch must be submitted to a heat treatment under specific conditions to newly produce components insoluble in a monocyclic aromatic hydrocarbon solvent without substantially producing a quinoline-insoluble component. This imposes significant restriction on the amount of components insoluble in the monocyclic aromatic hydrocarbon solvent produced in the heat-treated materials, which will lead to a limited yield of the spinning pitch.

In order to resolve these problems and to provide a more efficient process, we have conducted continued studies on the previously proposed process. As a result, we have found that it was possible to produce a considerable amount of additional insoluble components through a heat treatment of the refined heavy oil or pitch under specific conditions to induce formation of insoluble components, removal and recover of the insoluble components thus formed to obtain a mother liquor, i.e., solvent solution of soluble component, followed by removal of the solvent from the mother liquor to obtain a 0 soluble component, and repeated heat treatment of the soluble components under the same conditions. We have also found that a mesophase pitch prepared from this insoluble components additionally formed can be used for the production of carbon fibers with more excellent characteristics. Such findings have led to the completion of the present invention.

Accordingly, the first object of the present invention is to provide an efficient, economical, simple, easy and stable continuous process for conducting a heat treatment of any kind of pitches to convert them into a high softening point pitch. The second object of the present invention is to provide an efficient, economical, simple, easy and stable continuous process to conduct a heat treatment for producing a pitch suitable for producing pitch-based carbon fibers. The third object of the present invention is to provide a process for preparing an especially homogeneous mesophase pitch with a low softening point for the production of pitch-based high-performance carbon fibers. The fourth object of the present invention is to provide a process for preparing an especially homogeneous mesophase pitch satisfying all of the following characteristics at the same time; i.e., a Mettler method softening point of below 310° C., a mesophase content of not less than 90% in terms of area percentage of the portion exhibiting optical anisotropy when observed on a polarizing microscope, a quinoline-insoluble content of not more than 10 wt %, a xylene-soluble content of not more than 10 wt %, and a pyridine-insoluble content of not less than 25 wt %. When the mesophase pitch prepared by the second to fourth embodiments of the present invention is used for the production of a carbon fiber, high-performance carbon fibers carbonized at 1,000° C. with a tensile strength of at least 300 kg/mm$^2$, a tensile strength at a graphitized state of at least 400 kg/mm$^2$, and modulus of elasticity at a graphitized state of at least 60 ton/mm$^2$ could be easily produced.

The fifth object of the present invention is to achieve a significant increase in the yield of the mesophase pitch from the refined heavy oil or pitch, and to provide a process for continuously carrying out the operation for increasing the yield. According to the present invention, it is possible to remarkably improve the overall efficiency and economy of a process for producing a mesophase pitch.

The sixth object of the present invention is to provide a process for preventing the formation of coke-like solid materials, which should not be included in a spinning pitch, throughout the process, thus eliminating the difficult procedure of removing the coke-like solid materials. According to the present invention, all of the steps can be operated continuously, providing an extremely efficient process.

The seventh object of the present invention is to provide a flexible process which can elastically absorb the influence due to variations in the properties of heavy oils or pitches used as the raw material. In other words, the process can produce a mesophase pitch with a constant property independent from the properties of the raw materials.

It is needless to say that the hydrogenated pitches and mesophase pitches prepared by the process of the present invention can be used not only for the production of carbon fibers, but also as raw materials for other kind of carbon products.

Other objects of the present invention wi be apparent to those in the art from the descriptions given hereafter and the drawings attached herewith.

In view of this background, we have conducted extensive studies and established the present invention.

Thus, the gist of the first embodiment of the present invention resides in a continuous process for preparing a high softening point pitch which comprises heat-treating a heavy oil or pitch by dispersing said heavy oil or pitch in a gas stream of an inert gas or superheated vapor as fine oil droplets, and bringing the dispersed fine oil droplets into contact with the inert gas or superheated vapor, at 350°–500° C. under a reduced or normal pressure.

And the gist of the second embodiment of the present invention resides in a process for preparing a mesophase pitch for the production of high-performance carbon fibers which comprises:

using, as a raw material, a heavy oil or pitch of coal or petroleum origin which is substantially free from a material insoluble in a monocyclic aromatic hydrocarbon solvent, and subjecting said raw material to a successive four-step treatment comprising:

a first continuous step of heat-treating said raw material in a tubular heater under an increased pressure at a temperature of 400°–600° C., thus producing 3–30 wt % of xylene-insoluble component in the heat-treated material without substantially producing a quinoline-insoluble component, a second continuous step of distilling or flashing said heat-treated material obtained in the first step at a temperature below 350° C. as converted to that under norma pressure to remove a portion of light fractions thus obtaining a thermal-cracked heavy component, a third continuous step of adding to said thermal-cracked heavy component 1-5 times by weight of a monocyclic aromatic hydrocarbon solvent or other solvent having the same degree of dissolving ability with the monocyclic aromatic hydrocarbon solvent, and separating and collecting an insoluble component to obtain a high-molecular-weight bituminous material, and a fourth continuous step of removing the solvent from the mother liquor which has been obtained from the mixture of the solvent and the thermal-cracked heavy component by removing the insoluble component contained therein in the third step, thus obtaining a component substantially soluble in said monocyclic aromatic hydrocarbon solvent;

while recycling whole or a portion of said soluble component produced in the fourth step to the first step, hydrogenating said high-molecular weight bituminous material obtained in said third step by heat-treating the same in the presence of a hydrogen-donating solvent, thereby obtaining a hydro-treated liquid, or further removing the solvent to obtain a substantially optically isotropic hydrogenated pitch, and heat-treating said hydro-treated liquid or hydrogenated pitch by dispersing it in a gas stream of an inert gas or superheated vapor as fine oil droplets, and bringing the dispersed fine oil droplets into contact with the inert gas or superheated vapor, thereby converting said hydro-treated liquid or hydrogenated pitch into a mesophase pitch.

The gist of the third and fourth embodiments of the present invention will be apparent by those in the art from the descriptions given below and claims, and can easily be derived from the gist of the second embodiment mentioned above by simply eliminating some features from it.

DETAILED DESCRIPTION OF THE INVENTION

Figure 1:
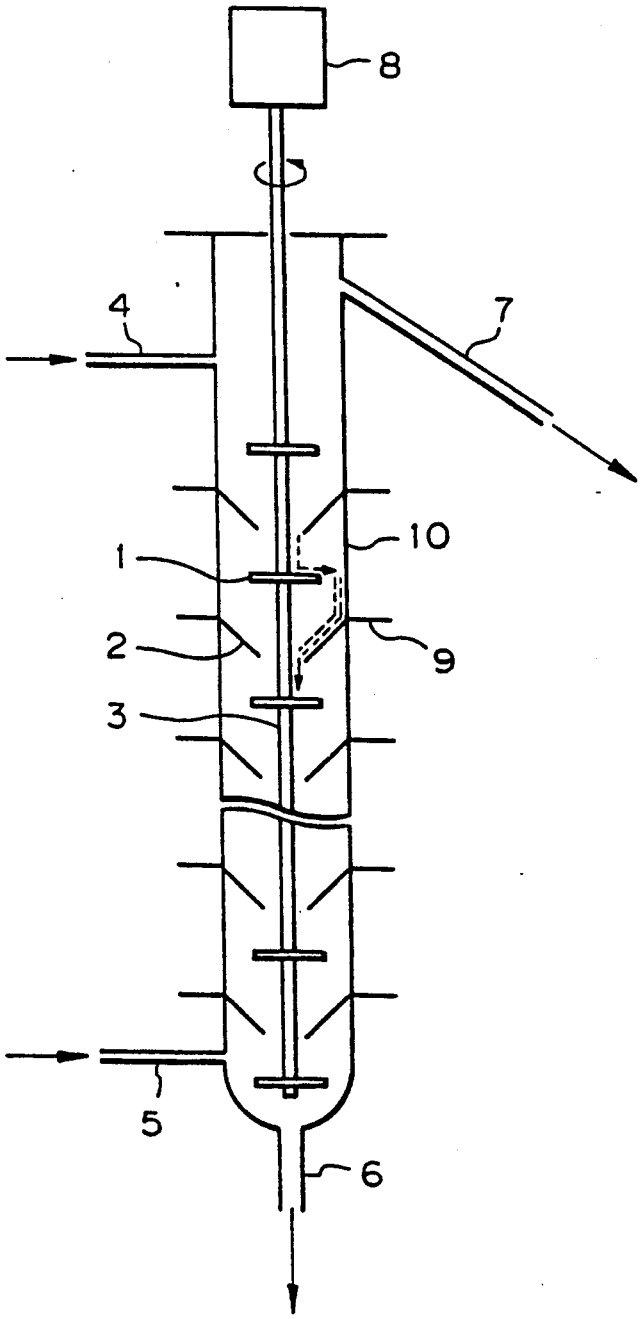
FIG. 1 is a simplified, schematic cross sectional view to show the structure of an example of an apparatus used in the present invention.

For the convenience of explanation, in the followings, the present invention will be described in detail relative to the first and second embodiments of the present invention with necessary additional explanations relative to the third and fourth embodiments. The first embodiment of the present invention will be explained firstly as follows:

Heavy oils or pitches (hereinafter referred to as "Heavy Oil(s)") used in the process of the present invention as raw materials are not specifically limited in terms of their origin and history, properties, or the like, in as much as they can provide a pitch with a high softening point. It is a matter of course that Heavy Oil used as a raw material must be changed according to the characteristics desired to the target pitches. For instance, when a spinning pitch for carbon fiber production is to be produced, pretreated Heavy Oil described in several prior art publications as mentioned previously can be used as raw materials for the process of the present invention. That is to say, the continuous process of the present invention can be applied to almost all the processes mentioned above in which a batch system is used for the heat treatment for producing a spinning pitch. When the target pitch is a spinning pitch for producing HP carbon fibers, it is necessary to obtain a homogeneous mesophase pitch with a low softening point. In such a case, it is desirable that Heavy Oil or high-molecular-weight bituminous materials derived therefrom be hydrogenated in advance. One of the processes for carrying out this hydrogenation is to effect the heat treatment of Heavy Oil or high-molecular-weight bituminous materials in the presence of a hydrogen-donating solvent. It is possible, however, for the practice of the present invention, to use as a raw material a hydrogenated pitch which is obtained by first hydrogenating Heavy Oil or high-molecular-weight bituminous materials in the presence of a hydrogen-donating solvent, and then eliminating the solvent and light fractions. Alternatively, it is possible to use the hydrogenated Heavy Oil or high-molecular-weight bituminous materials as they are without eliminating the hydrogen-donating solvent. Using the Heavy Oil or high-molecular-weight bituminous materials containing the hydrogen-donating solvent is preferred to ensure the simplicity of the manufacturing facilities and their operation.

The process of the present invention can also be applicable to the preparation of pitches for use in other than the production of carbon fibers, where the heat treatment is carried out by a batch system, or a continuous system such as conventional vacuum distillation, flash distillation, or the like. As mentioned above, although, any Heavy Oil may be used as the raw material without special limitations so long as the same can provide a high-softening point pitch and the pitch produced by the process of the present invention is superior in its characteristics to that obtained by conventional processes, such factors as whether the pitch obtained is a mesophase pitch for HP carbon fibers, an isotropic pitch for GP carbon fibers, or other types of high-softening point pitches used for other purposes are determined by the pretreatment of the Heavy Oil to be employed as the raw material for this process. Therefore, the Heavy Oil used as a raw material should generally be selected from those having undergone pretreatment suitable for the target pitches.

One of the features in the process according to the present invention is dispersing the Heavy Oil as fine oil droplets in a gas stream of an inert gas or superheated vapor. By this dispersion of fine oil droplets in the gas stream, a huge surface area is provided with the Heavy Oil, which is much greater than and even not to compare with that provided by a thin-film formation on the vessel wall. This huge surface area makes the elimination of light fractions by vaporization very easy, even under the same treatment conditions, such as the temperature, pressure, and the like, as those employed in conventional processes. Also, a fine oil droplet with a minute distance from the center to its surface requires only a very short time for mass transfer. For the two reasons, it is possible to extremely shorten the time required for the elimination of light fractions. It is well known that the presence of light fractions in the reaction system, wherein thermal polymerization of pitch is to be carried out, depresses the thermal polymerization reaction. Also, it is known that a too small content of light fractions in the reaction system increases the concentration of molecules to be polymerized, and thus assists in promoting the reaction rate. Since elimination of light fractions can be completed in an extremely short time in the process of the present invention, as mentioned above, the concentration of the molecules for polymerization in the thermal polymerization reaction increases very swiftly. This serves to promote the reaction speed, and thus to shorten the time required for the thermal polymerization. These actions shorten the overall time required for the treatment as well as the residence time of the materials to be treated, making it possible to use a smaller facility for the treatment, and assisting in depressing the coke formation.

The continuous treatment according to the process of the present invention is carried out under a reduced or normal pressure range, and at a temperature of 350°-500° C. If the temperature is not high enough, removal of the light fractions can only be performed insufficiently. If the temperature is too high, on the other hand, excessive thermal polymerization such as coking tends to take place, even though the time required for the treatment is short.

The treatment under a reduced pressure is desirable for promoting vaporization of the light fractions at a lower temperature. When the softening point of the target pitch i considerably higher as in the case of preparing a mesophase pitch for HP carbon fibers, however, lowering the treatment temperature may result a treatment of the pitch at high viscosity that it may occasionally be difficult to disperse the pitch as fine oil droplets. Therefore, the temperature and pressure of the treatment must be determined such that the viscosity of the pitch does not become too high at the temperature of treatment. Generally, the viscosity of the pitch should not be more than 100 poise, but desirably not be more than 50 poise at the treating temperature.

Nitrogen, helium, argon, or the like may be used as an inert gas in the process of the present invention. As a superheated vapor, a high-temperature steam or a high-temperature temperature vapor of low-boiling point organic compounds, low-boiling point oils, or the like, which is not reactive at the treatment temperature may be used. (These inert gases and superheated vapors are hereinafter referred to collectively as "Inert Gas(es)".) There are some cases, the use of a low-boiling point organic compound or a low-boiling point oil, if they remain in the pitch, may markedly impair pitch's characteristics. Thus, the use of an inert gas is desirable in some cases according to the intended purposes.

Means for dispersing Heavy Oil in a gas stream of Inert Gas may be that which utilizes the pressure of a pump or the like such as used in a fuel oil burner, or that which utilizes the negative pressure which is generated by a high-speed fluid produced by a device such as an ejector. Particularly, preferable means is a method comprising dropping Heavy Oils onto a rotating disk-type structure and purging them in the direction substantially perpendicular to the rotating axis of the disk by means of the centrifugal force of the rotating disk-type structure. Since this method enables the uniform dispersion of the Heavy Oil in a plane substantially perpendicular to the rotating axis, it is possible to bring the Heavy Oil uniformly into contact with the Inert Gases which flow through the treatment vessel. Non-uniform contact of the dispersed oil droplets and Inert Gas may result in an uneven rate of vaporization of light fractions, and thus is not desirable. In order to ensure the uniform contact of these materials, it is desirable to pass the Inert Gas substantially perpendicular to the direction of the movement of the dispersed oil droplets.

The disk-type structure may take any form such as a disk, a cone, a structure with protrusions or trenches such as a turbine impeller, or a structure with a spherical or bowl-like shape. However, a disk having the simplest structure can well bring about the intended effect.

It is especially preferable that the dispersions and the collections of the oil droplets are conducted repeatedly by using a multi-stage combination of disk-type structures and collecting pans, for example, such that the Heavy Oil is dispersed as fine oil droplets in a gas stream of the Inert Gas by means of the disk-type structure, and brought to come into contact with the Inert Gas to eliminate light fractions therefrom, and the pitches thus formed are collected by means of a collecting pan and dropped onto the next succeeding disk-type structure, thereby dispersing the pitches again in a gas stream of the Inert Gas. This is because elimination of light fractions is promoted even more at a lower temperature by the multi-stage dispersion of the oil droplets, which can help prevent undesirable excessive thermal polymerization such as coking from taking place. In addition, treatment of the pitches can be performed extremely uniformly, since the collected pitches can be very efficiently mixed and agitated when they are again dispersed. The number of stages of this dispersion/collection combination may vary depending on the properties of the Heavy Oil to be used as the raw material, and on the desired characteristics of the intended pitches. A larger number of stages is desired when intended pitches are those with a higher softening point or of which characteristics may greatly change due to the existence of light fractions, such as a spinning pitch for the production of carbon fibers. Usually, however, the number of the combined stages of the disk-type structures and the collecting pans may be less than 20.

The force which disperses the Heavy Oil from the periphery of the disk-type structure is the centrifugal force, the magnitude of which is determined by the distance between the rotating axis and the disk periphery (R), and the linear velocity (V) at the periphery. The higher rotation speed of the disk-type structure gives smaller diameter of the oil droplets dispersed in the gas stream of the Inert Gas, which gives rise to a better removal of light fractions. Too high of a rotating speed, however, results in the phenomenon that the Heavy Oil is blown off from the upper surface of the disk-type structure. This can impair the uniform dispersion of the oil droplets in the gas stream of the Inert Gas. Conversely, the diameter of the oil droplet becomes larger as the speed of the rotation becomes smaller. Finally, this gives rise to the tendency of the oil droplets falling down from the periphery of the disk-type structure, which markedly impairs the efficiency of the light fraction elimination. Although the higher rotating speed creates smaller diameter oil droplets, by which a better efficiency is obtained, excessively high rotation speed is not always desirable when one considers a larger scale facility. In the normal practice of the present invention, a rotation of below 1,000 rpm is sufficient. The centrifugal force also changes depending on the size of the disk-type structure. The larger disk diameter can suffice the smaller rotation needed to produce the sam magnitude of centrifugal force. The size of the disk-type structure and the rotation of the disks can be determined such that the value ($V^2/R$) is equal to or larger than 10 m/sec$^2$, wherein V represents the linear velocity of the disk-type structure (m/sec) at its periphery, and R is the radius of the disk (m).

The flow rate of Inert Gas to come into contact with the oil droplets for eliminating light fractions may be 0.1–10.0 m/sec, and preferably 0.1–1.0 m/sec, at the plane on which the Heavy Oil flows out from the periphery of the disk-type structure. If the flow rate is smaller than this range, the elimination of the light fractions may occasionally be insufficient. A flow rate greater than this range will result in the loss of Inert Gas, since the elimination of the light fractions reaches its ceiling at a certain flow rate. An extremely high rate of flow may entrain oil droplets from the vessel with the gas.

The amount of Inert Gas to be used also has a close relationship with the amount of the Heavy Oil to be treated. In the present invention, the feed rate of Inert Gas per unit weight of Heavy Oil to be treated may be selected from the range of 0.1–10 m$^3$/kg, and preferably 0.3–3 m$^3$/kg, at the temperature and pressure at which the Heavy Oils are treated. If the feed rate of Inert Gas is considerably smaller than this range, the effect of the elimination of light fractions is impaired so that it becomes necessary to raise the treatment temperature for obtaining the intended pitch to a level at which coking may take place in the vessel, and therefore, the use of such a small feeding rate of the Inert Gas is not preferable. An excessive feed rate, on the other hand, will only causes the lose of the Inert Gas and increase the operation cost, since, as mentioned above, the elimination of light fractions reaches the ceiling at a certain flow rate.

As mentioned previously, not only eliminating the light fractions, but also effecting a moderate polymerization as appropriate to the intended pitch, are necessary in the process of preparing a pitch from Heavy Oil. The process of the present invention brings about an effect which is quite different from usual operations such as vaporization or drying in that it is capable of performing the elimination of light fractions and thermal polymerization simultaneously, and with excellent balance through the proper selection of the treatment conditions from among the aforementioned ranges conforming to the intended purposes.

For more effective operation of the treatment according to the present invention, it is desirable to flow Heavy Oil and Inert Gas countercurrently by providing the Heavy Oil inlet into the upper portion of the multi-stage treatment vessel, and the Inert Gas inlet into the lower portion. Through this arrangement, the oil droplets dispersed in the final part of multi-stage can contact with a fresh feed of the Inert Gas, giving rise to better efficiency of the light fraction removal.

A preferred embodiment of the apparatus used in the present invention will now be illustrated referring to the drawing. In FIG. 1, 1 means a rotating disk, 2 means an inverted frustconical collecting pan, and 3 means the rotating axis. Numeral 4 means the nozzle for feeding preheated Heavy Oil, 5 means the nozzle for feeding preheated Inert Gases, 6 means the nozzle for discharging the product pitch, 7 means the venting nozzle for spent gas and vaporized light fractions, 8 means a motor for rotating the rotating disk, 9 means a flange for fixing the collecting pan, and 10 means the vessel of the apparatus. The apparatus shown in FIG. 1 is designed such that disks 1 are fixed at the rotating axis 3 by means of bolts, and the collecting pans 2 are fixed by means of flanges 9. This arrangement makes it possible to change the number of stages of the disk-collecting pan combination and their relative locations.

Preheated Heavy Oil is charged from nozzle 4 into the apparatus of FIG. 1. The uppermost part of the vessel 10 constitutes a flash zone so that a certain amount of light fractions may be removed here and discharged through nozzle 7. The pitch produced here is collected by the uppermost collecting pan 2 and drops down from there onto the second disk 1. The pitch thus dropped onto the second disk 1 is dispersed as oil droplets in the direction substantially perpendicular to the rotation axis 3 of the disk via its centrifugal force. The oil droplets come into contact with the preheated Inert Gas which is charged from the nozzle 5 at the bottom, thereby the light fractions being eliminated therefrom. The pitch thus produced is collected by the second collecting pan 2 and drops down onto the third disk 1, where it is again dispersed as oil droplets. This dispersion and collection sequences are repeated as the pitch travels down the vessel 10, while light fractions are removed therefrom and a moderate degree of thermal polymerization is effected. The pitch is finally discharged from the vessel 10 by pump, or the like through nozzle 6 at the bottom of the vessel 10.

in the apparatus having the construction shown in FIG. 1, the direction of the movement of the discharged oil droplets and the flow of Inert Gas are substantially perpendicular to each other, and the flows of the pitch and Inert Gas in the vessel are countercurrent with each other because the nozzles for feeding the raw Heavy Oil and Inert Gas are installed on opposite sides of the vessel. In this way, better efficiency can be achieved, because the arrangement makes possible the pitches with increasing advanced treatment to come into contact with the fresh Inert Gas. If desired, the Inert Gas can be fed to each of the stages. In the apparatus having the structure as shown in FIG. 1, the pitch proceeds in the direction of the wall of vessel 10 from the periphery of the disks as indicated by the broken line in FIG. 1. A wetted wall portion also thus exists in this apparatus. A trial was made to change this wetted wall area through which the pitch flows down by changing the disk installation position. As a result it was unexpectedly found that the wetted wall area had no substantial effect on the characteristics of the pitch produced through the apparatus used in the process of the present invention wherein Heavy Oil is dispersed as fine oil droplets in a gas stream of the Inert Gas.

Although this fact is materially described in Example 2 shown hereafter, for the purpose of ready reference, summary of the experimental results is recited here.

That is, to a heavy oil (1 weight part) obtained by distilling coal tar at 280° C., xylene (2 weight parts) was added, and the insoluble material was separated by filtration. Solvent was distilled off from the filtrate to obtain the refined heavy components, which were continuously heat-treated in a tubular heater at a temperature of 510° C., pressure of 20 Kg/cm$^2$G, and recycle ratio of 3 to effect thermal cracking. Xylene was again added to the cracked heavy oil to separate the insoluble component newly formed through a continuous centrifugal operation. The insoluble component thus obtained was washed with xylene, dried to produce xylene insoluble high-molecular-weight bituminous material. The high molecular-weight bituminous material (1 weight part) was dissolved in hydrogenated anthracene oil (3 weight parts) and hydrogenated in a tubular heater at 440° C. and 50 Kg/cm$^2$G. The hydrotreated liquid discharged from this tubular heater was cooled, and submitted to the treatment according to the present invention. The apparatus used in the experiment was a vessel having internal diameter of 100 mm, a distance between the two collecting pans of 130 mm, a rotating disk diameter of 70 mm, and a 40 mm diameter hole provided in the lower end of each collecting pan. The vessel incorporated 5 stages of this disk-collecting pan combination. The experiments were conducted for the cases where the distances between the upper surface of each disk and the uppermost end of the collecting pan (i.e., the point where the flange for the pan was fixed) immediately below thereof, were 30 mm, 60 mm, and 90 mm. A continuous operation was carried out at a temperature of 460° C., raw material feed rate of 6.5 kg/hr, nitrogen gas feed rate of 80 l/min (as converted to the volume at normal temperature), and disk rotation speed of 700 rpm. The softening point of the thus-obtained pitches measured by Mettler method were 303° C. for all cases, irrespective of the position at which the disks were installed. The areas of the wetted wall portion (shown by the broken double line in FIG. 1) for the 60 mm and 90 mm distances (between the disk and the flange) were 1.5 and 2.0 times that for the 30 mm distance. This demonstrates that the characteristics of the pitch obtained remained the same when the wetted wall portion was enlarged to two times. Thus, the effect of the wetted wal portion in this method of dispersing pitches as fine oil droplets is considered to be almost completely negligible or very small, if any, as compared to the overall production effect of the apparatus.

An accurate residence time cannot be calculated, because the flow rate and viscosity of Heavy Oil at the inlet and of the pitch at the outlet greatly differ in the process of the present invention. For this reason, the period of time starting from when Heavy Oil was charged into the vessel for the first time and ending when the pitch began to come out from the bottom was measured and taken as the apparent residence time in the treatment vessel. As a result, it was found that when the distances between the disk and the flanges were 30 mm, 60 mm, and 90 mm, the apparent residence times were 2.5, 3.5, and 5.0 minutes, respectively. Thus, changing the wetted wall area by altering the disk position causes the residence time to change, but it minimally affects the characteristics of the pitch produced. These findings were contrary to our expectations. When apparatus of the type shown in FIG. 1 is used in the present invention, the apparent residence time is less than 20 min, and is most usually less than 10 min.

In addition, when the apparatus of the type shown in FIG. 1 is used in the present invention, the treatment of the pitch can be performed very uniformly because of the absence of the space wherein the pitch can retained.

It is needless to say that the type of apparatus is not limited to that shown in FIG. 1. Any type of apparatus with a construction by which Heavy Oil can be dispersed as fine oil droplets and brought into contact with the Inert Gas can be used.

According to the process of the present invention, a pitch with a high softening point can be continuously produced by dispersing the raw material Heavy Oil, into a gas stream of the Inert Gas as fine oil droplets, bringing the oil droplets into contact with the Inert Gas to effectively eliminate light fractions, and, at the same time, to effect moderate thermal polymerization. The process is, therefore, remarkably efficient as compared with conventional processes employing a batch system. Moreover, the process provides a convenient means for strictly controlling the treatment conditions, which has been a major problem in the conventional batch-type processes. This makes it possible to produce a homogeneous pitch even in a large-scale facility.

In addition, the process of the present invention was established by ignoring the old philosophy that a liquid film had to be produced on the wetted wall surface, the method employed in the conventional continuous processes; and by adopting a novel method of dispersing Heavy Oil into a gas stream of the Inert Gas as fine oil droplets. This method brought about a higher rate of vaporization of the light fractions as well as the remarkable effect of causing uniform and moderate thermal polymerization to occur. The process completely eliminates the necessity of undesirable measures such as circulation of pitch and installation of large apparatus, which conventional processes must adopt because they require relatively longer period of time for the treatment. Thus, the process of the present invention provides a remarkably efficient process for preparing pitches. The process can be suitably applied to the preparation of pitches for HP carbon fiber production, in which the presence of even a slight amount of light fractions or the presence of solid materials such as cokes generally cause significant problems.

Furthermore, the process of the present invention offers wide utility in that it can produce a variety of pitches by selecting a Heavy Oil suitable for the intended products. In addition, when the process of the present invention is carried out using the apparatus of the type illustrated hereinbefore, i.e., that is constructed with a combination of rotating disks and collecting pans, it is possible to alter the number of stages according to the intended purposes. This, in turn, enables appropriate conditions for the production to be selected from a wide range of conditions.

In the followings, the second to fourth embodiments, especially the second embodiment of the present invention will be explained in detail.

As the raw materials used in the present invention, heavy oils of coal origin, heavy oils of petroleum origin and pitches obtainable therefrom can be cited. The term "heavy oil of coal origin" as used herein means coal tars, liquefied coals, and the like, the term "heavy oil of petroleum origin" as used herein means residue of naphtha cracking (naphtha tar), residue of gas oil cracking (pyrolysis tar), residue of fluidized catalytic cracking (decant oil), and the like, and the term "pitch" as used herein means a heavier fraction of the heavy oils and is obtainable from the heavy oils by distillation, heat treatment, hydro-treatment, or the like. Any mixture of the heavy oil and/or the pitch can also be used. As defined previously in the descriptions relative to the first embodiment of the present invention, in the followings, the heavy oils, the pitches or mixtures thereof are collectively referred to as "Heavy Oil(s)", too.

Chemical and physical characteristics of some kinds of Heavy Oil are shown in Table 1.

TABLE 1 (1)

| Kind of heavy oil | Coal tar | Naphtha tar | Pyrolysis tar |
|---|---|---|---|
| Sp. Gr. (15/4° C.) | 1.10–1.20 | 1.05–1.10 | 1.05–1.15 |
| Viscosity (cSt. at 100° C.) | 1–200 | 5–100 | 2–250 |
| H/C atomic ratio | 0.6–0.8 | 0.9–1.0 | 0.8–1.2 |
| Asphaltene (wt %) | 15–40 | 10–20 | 10–25 |
| Xylene insolubles (wt %) | 2–20 | 0–1 | 0–10 |
| Quinoline insolubles (wt %) | 0.1–5.0 | less than 1 | less than 1 |
| Conradson carbon (wt %) | 15–30 | 10–20 | 10–25 |
| Distillation (°C.) | | | |
| IBP | 180–250 | 170–210 | 180–250 |
| 10 vol % | 210–300 | 210–240 | 240–320 |
| 30 vol % | 270–370 | 230–280 | 270–340 |
| 50 vol % | 360–420 | 270–350 | 330–390 |
| 70 vol % | 470–530 | 320–400 | 380–460 |

TABLE 1 (2)

| Kind of heavy oil | Decant oil | Hydrogenated coal tar |
|---|---|---|
| Sp. Gr. (15/4° C.) | 0.95–1.10 | 1.10–1.20 |
| Viscosity (cSt. at 100° C.) | 2–50 | 1–50 |
| H/C atomic ratio | 1.2–1.5 | 0.8–1.0 |
| Asphaltene (wt %) | 0–5 | 10–30 |
| Xylene insolubles (wt %) | 0–1 | 1–10 |
| Quinoline insolubles (wt %) | less than 1 | 0–2.0 |
| Conradson carbon (wt %) | 2–10 | 10–25 |
| Distillation (°C.) | | |
| IBP | 170–240 | 160–270 |
| 10 vol % | 300–370 | 200–350 |
| 30 vol % | 350–400 | 250–410 |
| 50 vol % | 370–420 | 350–470 |
| 70 vol % | 400–450 | 460–550 |

The term "monocyclic aromatic hydrocarbon solvent" herein used means benzene, toluene, xylene, etc. They may be used either alone or as a mixture thereof. These solvents are, of course, not necessarily pure compounds, and it is sufficient that if they contain essential amount of these compounds. The solvent used for the separation of insoluble materials from a raw material Heavy Oil or the separation of insoluble components newly formed in a tubular heater is not limited to the benzene, toluene, xylene, and the like. For example, a mixed solvent having a dissolving ability which being equivalent or substantially equivalent to the dissolving ability of benzene, toluene, xylene, and the like can be used without any difficulties. Such a mixed solvent can easily be prepared by simply mixing, in a suitable ratio, a poor solvent, such as n-hexane, n-heptane, acetone, methyl ethyl ketone, methanol, ethanol, kerosene, gas oil, naphtha, and the like with a good solvent, such as quinoline, pyridine, coal tar-gas oil, wash oil, carbonyl oil, anthracene oil, aromatic low-boiling point oil obtainable by distilling a heavy oil, etc. It is preferred, however, to use a solvent having a simple composition, such as benzene, toluene, xylene, and the like, so as to simplify the solvent recovering procedure. The combination of the above-mentioned poor and good solvents can be deemed to be the equivalent of a monocyclic aromatic hydrocarbon solvent such as benzene, toluene, xylene, and the like because of their equivalent dissolving ability. The aforementioned monocyclic aromatic hydrocarbon solvents, inclusive of the above combined solvents, are hereafter referred to simply as "BTX solvent(s)" or more simply as "BTX" in the description of this specification. Accordingly, it is to be noted that the term "BTX solvent(s)" or "BTX" used herein has somewhat wider scope than the term "BTX" commonly and usually used in the art.

The raw material to be fed to the heat treatment in a tubular heater in the first step of the process of the present invention should be the material that does not substantially produce insoluble materials, when mixed with 1–5 times amount by weight of a BTX solvent, i.e., when 1 weight part of the raw material is mixed with 1–5 weight parts of a BTX solvent. Taking coal tars as an example, since coal tars are a heavy oil by-produced in the dry distillation of coal, they usually contain very fine soot-like carbons which are generally called free carbons. The free carbons are known to interfere with the growth of mesophase when Heavy Oil is heat-treated, and moreover, being a solid insoluble in quinoline, the free carbon becomes a cause of the fiber cut off in the spinning operation. Further, coal tars contain high-molecular-weight materials insoluble in BTX solvent, and the high-molecular-weight materials are easily converted into quinoline-insoluble components during a heat treatment. These BTX solvent-insoluble materials contained in coal tars vary in both their amount and quality depending on the production conditions of each coal tar. Since they are not produced specifically to be used as a raw material for producing carbon fibers, if they are extracted and used as a precursor of the spinning pitches, they may affect the properties of a spinning pitch and the characteristics of the produced carbon fibers on account of the variations in their properties. Removing free carbons and BTX solvent-insoluble materials from raw Heavy Oils is, therefore, important not only for preventing the formation of coke-like solid materials in the heat treatment in the tubular heater of the first step and clogging the tubes, but also for preventing the formation of a quinoline-insoluble component in the final product mesophase pitch, thus producing a spinning pitch with a stable property.

This removal of insoluble materials using a BTX solvent from raw Heavy Oils can be omitted, when the Heavy Oil contains materials insoluble in a BTX solvent very little or not at all. Heavy Oil of petroleum origin such as, for example, naphtha tar is generally composed of components soluble in the BTX solvent in its entirety, and further, there may be Heavy Oil, even if coal origin, which is completely or substantially free of materials insoluble in a BTX solvent for some reasons. These raw materials need not be subjected to the refining pretreatment mentioned above, because there is no or substantially no insoluble material to be removed by the refining pretreatment mentioned above, and therefore, there is no merit expected from this pretreatment. Such raw materials containing no or substantially no materials insoluble in a BTX solvent can be regarded as Heavy Oil latently received the pretreatment for removing the insoluble materials, and therefore, such raw materials are also within the scope of the definition of "Refined Heavy Component". Even in the case where the above-mentioned refining pretreatment can be omitted, it is desirable in order to obtain a more homogeneous excellent quality mesophase pitch, to subject the Heavy Oil to a heat treatment so that less than 10 wt %, based on the raw material, of xylene insoluble materials are formed, and then to separate and remove these formed insoluble materials. Either a batch process, e.g. heat treatment by the use of an autoclave, or a continuous process, e.g. heat treatment by the use of a tubular heater may be employed for the heat treatment. It is not efficient, however, that if the amount to be removed as a material insoluble in a BTX solvent becomes too large, because it may result lowering the yield of mesophase pitch, i.e., the ultimate product.

For example, a naphtha tar having Sp. Gr. 1.0751 and xylene-insoluble (hereinafter occasionally abbreviated as XI) content of 0 wt % is heat-treated in a tubular heater with 6 mm internal diameter and. 40 m length which being kept within a molten salt bath, under a pressure of 20 $Kg/cm^2G$ at a feed charge rate of 17.5 kg/hr and at a temperature range of 440°-500° C., XI content of the heat-treated product changes depending upon the heat treatment temperature, i.e., 0.2 wt %, 1.2 wt %, 4.0 wt %, 8.1 wt % and 27.6 wt % at 440° C., 460° C., 480° C., 490° C. and 500° C., respectively. Accordingly, when preliminary heat treatment is conducted continuously by using a tubular heater as mentioned above, it is desirable to conduct the heat treatment at a temperature range of 460°-490° C. so as to form an appropriate amount of XI material which being separated and removed in the pretreatment. If the same naphtha tar is heat-treated in batchwise by the use of an autoclave under a pressure of 15 $Kg/cm^2G$ for 2 hr at a temperature range of 400°-440° C., XI content of the heat-treated products varies depending upon the heat treatment temperature, such as 0.3 wt %, 1.5 wt %, 3.1 wt %, 6.8 wt % and 13.5 wt % at 400° C., 410° C., 420° C., 430° C. and 440° C., respectively. Accordingly, if the preliminary heat treatment is conducted in batchwise, it is preferable to use a heat treatment temperature of 410°-430° C. so as to form an appropriate amount of XI material. From the above, it is apparent that the conditions, such as temperature, to be used in the preliminary heat treatment differ depending upon either a continuous heat treatment by the use of a tubular heater is adopted or a batchwise heat treatment by the use of an autoclave is adopted. Therefore, actual process conditions for conducting the preliminary heat treatment should desirably be decided by experiments.

Further, in the cases shown above, the product obtained by a continuous heat treatment within a tubular heater at a temperature of 500° C. contains almost no quinoline-insoluble (hereinafter occasionally abbreviated as QI) component. Contrary to this, the product obtained by a batchwise heat treatment in an autoclave at 440° C. at a holding time of 2 hr contains only 13.5 wt % of XI material, nevertheless also contains 1.3 wt % of component. When compared the XI contents of the former and the latter products, the XI content of the latter product is lower than that of the former product. It is apparent from the descriptions above, when Heavy Oil is heat-treated in the preliminary step, it must be considered that what kind of operational procedures should be selected. It is preferable to use a continuous heat treatment by using a tubular heater, if the formation of excessively thermally polymerized high-molecular-weight bituminous materials, such as QI component, should be avoided.

The quantity of the BTX solvent to be used for the amount of the Heavy Oil to be treated. A deficient quantity would make the mixed liquid viscous, which will worsen the extraction efficiency. On the other hand, the use of too much solvent would make the total volume of the material to be treated larger, thereby making the process uneconomical. Usually, the desirable amount of a BTX solvent to be used is 1-3 times by weight of the Heavy Oil. The amount of the insoluble materials formed when a BTX solvent of 1-5 times by weight of the Heavy Oil is added and the amount of the insoluble materials formed when a larger amount of a BTX solvent, e.g. several tens of times by weight, is added (This is usually done when the amount of solvent-insoluble materials is measured as a parameter of the property.) are not always the same. When the amount of the solvent is small, the amount of the insoluble materials formed is also small. Therefore, when a Refined Heavy Component obtained by removing insoluble materials formed by the addition of a solvent of 1-5 times by weight, i.e., using (Heavy Oil/solvent) weight ratio of (1/1-5), is subjected to analysis using several tens of times by weight of the solvent, i.e., (Refined Heavy Component/solvent) weight ratio of (1/several tens), a small amount of insoluble materials can occasionally be detected. The presence of this type of insoluble materials does not have any adverse effect on the practice of the present invention.

Any method can be employed for separating the insoluble materials, including centrifugation, filtration, and the like. In case fine solid materials such as free carbon, catalyst, or other impurities are contained, however, filtration is a preferred method to completely eliminate these solid materials. A Refined Heavy Component can be obtained by distilling off BTX solvents from the solution which has been obtained from the mixture of a Heavy Oil and a BTX solvent by removing insoluble materials contained therein.

Another desirable characteristics demanded of the Refined Heavy Component used in the process of the present invention is that it contains at least 10 wt %, preferably 20 wt %, of light fraction having a boiling point range of 200°-350° C., and its viscosity at 100° C. is not more than 1,000 cSt. A Refined Heavy Component which does not contain a light fraction with a boiling point below 350° C., even if it is free from any BTX-insoluble material, has so high melting point that it entails the inconvenience of maintaining the temperature of instrument, such as a pump, to be used to feed the material into the first step, high enough. Moreover, if such a Refined Heavy Component is heat-treated in the absence of a light fraction, the rate of thermal polymerization will become so large that solid materials such as cokes tend to be produced. The effect of the light fraction on the rate of thermal polymerization is already known in the art as described in Japanese Patent Laid-open No. Sho 59(1984)-82417 and U.S. Pat. No. 4,522,701. Even though generally available coal tar, naphtha tar, pyrolysis tar, and decant oil satisfy this requirement, it is desirable to prepare a pitch which is not excessively beyond the range of the aforementioned characteristics if these Heavy Oils are to be processed in advance by distillation, heat treatment, hydrogenation, or the like. It is possible, however, to use a Refined Heavy Component, which is completely free from a BTX-insoluble material but is outside the range of the aforementioned characteristics, by diluting with the addition of an aromatic oil having a boiling point range of 200°-350° C. The use of a Heavy Oil containing a large proportion of lighter fraction with boiling points below 200° C. is not advantageous, because of the high vapor pressure occurring in the tubular heater during heat treatment which requires a higher pressure for the treatment.

The process of the present invention is now illustrated in detail. The first step comprises heat treatment of the aforementioned Refined Heavy Component in a tubular heater to produce 3–30 wt % of xylene-insoluble components in the heat-treated material. This first step heat treatment is carried out under an increased pressure at a temperature of 400°–600° C. Specifically, it is desirable that the temperature and pressure at the outlet of the tubular heater be respectively 400°–600° C. and 1–100 Kg/cm$^2$G, and preferably 450°–550° C. and 2–50 Kg/cm$^2$G.

When conducting this heat treatment, it is preferable to exist an aromatic oil in the Refined Heavy Component to be treated. Such aromatic oil has a boiling range of 200°–350° C., and should not materially produce BTX-insoluble materials in conditions of the heat treatment in the tubular heater. The preferred aromatic oil may be a fraction obtainable by the distillation of the raw Heavy Oil and having a boiling range of 200°–350° C. The examples are wash oil (This fraction may also be called "absorption oil".) and the anthracene oil which are the 240°–280° C. fraction and the 280°–350° C. fraction, respectively of coal tars, and the fraction with corresponding boiling range obtainable from heavy oils of petroleum origin. When considering a view point of process economy, it is needless to say that it is better to use an aromatic oil obtained from the raw material Heavy Oil for the production of mesophase pitch than the use of an aromatic oil obtained from other sources. These aromatic oils help to avoid excessive thermal polymerization in the tubular heater, provide an adequate residence time so that the Heavy Oil may be thermally decomposed sufficiently, and further prevent coke clogging of the tubes. Accordingly, the aromatic oils must not thermally polymerize itself in a tubular heater to such an extent that their coexistence may accelerate the clogging of the tubes. Those containing high boiling fractions in a large amount, therefore, are not usable as the aromatic oils specified above. On the other hand, those containing a large amount of lighter fractions, e.g. boiling below 200° C., are not favorable, because a higher pressure is required to keep them in liquid state in the tubular heater. To achieve the purpose mentioned above, it is desirable that the material to be treated in this step contains 10–70% by weight of a fraction having boiling range of within 200°–350° C., i.e., the aromatic oil. When an aromatic oil is added to a Refined Heavy Component, the quantity of the aromatic oil to be added may be less than the quantity in weight of the Refined Heavy Component to be heat-treated. In case where the Refined Heavy Component contains a sufficient amount of aromatic oils of the above-mentioned boiling range, the addition of aromatic oils to the Refined Heavy Component may, of course, be saved or omitted.

The temperature and residence time of heat treatment should be selected from a range which produces 3–30 wt % of xylene-insoluble component in the heat-treated material and does not substantially produce any quinoline-insoluble component. Generally speaking, too low a temperature or too short a residence time not only decreases production of BTX-insoluble components, thus impairing the efficiency, but also produces BTX-insoluble components having too small a molecular weight, so that it becomes necessary to employ more severe heat treatment conditions for mesophase formation which is to be carried out succeeding the hydrogenation. This appears rather to cause the quinoline-insoluble content in the mesophase pitch to increase. Conversely, too high a temperature or too long a residence time results in excessive thermal polymerization, bringing about formation of a quinoline-insoluble component, as well as production of coke which may cause clogging of the tube to occur. When the temperature is in the range of 400°–600° C., a suitable residence time range is usually 10–2,000 sec, with a preferable range being 30–1,000 sec. In addition to the requirement that the BTX-insoluble component produced in the first step be substantially free from a quinoline-insoluble component, a more important factor in the determination of the heat treatment conditions in this first step is that such conditions be selected from the range which do not produce large amount of components insoluble in the hydrogen-donating solvent used in the succeeding hydrogenation treatment. The allowable amount of the hydrogen-donating solvent-insoluble components to exist, is dependent on the kind of the hydrogen-donating solvent, and thus cannot be numerically defined. It is sufficient, however, to confirm nonexistence of an insoluble material precipitant in a mixed solution of the hydrogen-donating solvent and the BTX-insoluble component obtained in the first step, which is prepared by mixing the latter with a required amount of the former to dissolution and left stand still at 80°–100° C. for overnight. When a considerable amount of the insoluble material precipitant is formed, continuous operation of the hydrogenation treatment will be difficult or almost impossible due to clogging of pumps or pipes. Existence of fine insoluble materials which produce no precipitant through this procedure poses no problem, because such fine insoluble materials can be reformed into soluble materials, on the one hand, and, on the other hand, because the solvent itself discharges hydrogen which assists to increase a dissolving ability. These can, however, be controlled only when a Refined Heavy Component which is substantially free from a BTX-insoluble material is used as the raw material for the heat treatment in the first step.

As to the pressure of the heat treatment, at a too low pressure, e.g. at a pressure of below 1 Kg/cm$^2$G at the outlet of the tubular heater, the lighter fractions of the Refined Heavy Component or aromatic oil will vaporize and liquid-gas phase separation will take place. Under this condition, polymerization will occur in the liquid phase so that a larger amount of QI components are produced and coke clogging of the tubes will result. Therefore, a higher pressure is generally preferable, but a pressure of above 100 Kg/cm$^2$G will make the investment cost of the plant unacceptably expensive. Therefore, the pressures which can keep the Refined Heavy Component to be treated and aromatic oil in a liquid phase are sufficient.

The heat treatment at this first step has a great influence on the characteristics of the ultimate products, i.e., the mesophase pitch, and of the carbon fibers produced therefrom. This heat treatment can never be carried out in a batch-type pressurized heating facility such as a commonly used autoclave. It is because a batch-type apparatus is incapable of effectively controlling the short holding time of 10–2,000 sec, and with such a batch system, one cannot help employing a lower temperature to complement a longer holding time in the order of hour or hours. But, we have experienced that the heat treatment at such conditions involves the production of a considerable amount of coke-like solid materials which are insoluble in quinoline, when the heat treatment is continued long enough to obtain a sufficient amount of BTX-insoluble components. Since the first step of the present invention requires a sufficient degree of thermal cracking reaction to take place while preventing the excessive thermal polymerization reaction, it is imperative that the heat treatment be conducted in a tubular heater under the specified conditions.

While considering the al factors mentioned above, the actual conditions for conducting the first step can be selected. A measurement to determine the fact that whether the selected conditions are appropriate or not is to determine the QI content of the product. The conditions giving a product containing more than 1 wt % of QI component are not suitable. It shows that an excessive thermal polymerization occurs in the tubular heater and clogging of tube by coking may arise. When using the heat-treated materials obtained under such severe conditions, after the heat treatment, it is indispensable that the excessively highly polymerized materials formed must be removed from the heat-treated product in any one of operational stages. Contrary to the above, when the product contains QI component less than 1 wt %, the removal of QI component after the heat treatment is unnecessary.

The accurate control of QI content of the product mentioned above can only be done by using a tubular heater and by the use of a Refined Heavy Component containing no or substantially no XI material.

Further, it was known that the process conditions, such as heating temperature and residence time, of the heat treatment in the tubular heater can be changed by providing a soaking drum after the tubular heater. This procedure can also be used in the process of the present invention. However, it is not preferable to select the conditions of the heat treatment in a tubular heater, if the conditions require to use a very long residence time in the soaking drum. The use of a very long residence time in the soaking drum gives similar effects as the use of a batchwise operation, such as an operation in an autoclave and gives the formation of QI component.

Accordingly, even if the soaking drum is used, the conditions of heat treatment in a tubular heater should be selected from the conditions described before.

The next second step comprises distillation or flashing of the heat-treated material from the first step under normal or a reduced pressure at a temperature of not higher than 350° C. (as converted to that under normal pressure) to obtain a thermal-cracked heavy component. The conditions of distillation or flashing in this second step are established such that the thermal-cracked heavy component to be produced contains at least 10%, preferably at least 20%, of light fraction having the boiling point range of 200°-350° C. and has a viscosity at 100° C. of below 1,000 cSt.

it is desirable that the properties of soluble component obtained by removing insoluble component from said thermal-cracked heavy component be adjusted in this second step such that the same meet the characteristics required as a raw material to be heat-treated in the first step, since this soluble component is circulated to the first step. Furthermore, it is desirable that the conditions of distillation or flashing be selected from the range which makes the boiling range of the thermal-cracked heavy component produced be higher than the BTX solvent to be used in the third step. If this thermal-cracked heavy component contains a thermal-cracked light fraction having the boiling point range which is near that of the BTX solvent, a fractionating column with a high efficiency is needed for the separation of the 8TX solvent and thermal-cracked light fraction in order to recover the BTX solvent in the fourth step.

The thermal-cracked heavy component obtained in the second step contains 3-30 wt %, usually 5-20 wt %, of BTX-insoluble component and does not substantially contain a quinoline-insoluble component.

This second step may include the operation for separating the distilled or flashed light fraction with boiling points below into fractions having a boiling point range of 200°-350° C. and those with a lower boiling range. The fractions having the boiling point range of 200°-350° C. may be used as is as the diluent in the first step, when the process employs an aromatic oil as a diluent in the first step.

The third step comprises addition of the BTX solvent to the thermal-cracked heavy components to separate and recover the BTX-insoluble components newly formed. It is desirable that the thermal-cracked heavy component to which the BTX solvent is added in this step is a liquid having a good fluidity at a temperature below the boiling point of the BTX solvent used. If the thermal-cracked heavy component is solid or very viscous at or hi9her than the boiling point of the solvent, a special facility such as a pressurized heating dissolver is required for mixing and dissolving such solid or viscous material with the BTX solvent. In addition to the above, when trying to mix around room temperature, it takes a long time for mixing and dissolving, thereby making the process uneconomical.

When the thermal-cracked heavy component is a liquid which is fluid enough at the temperature below the boiling point of the solvent, mixing and dissolving the thermal-cracked heavy component and the BTX solvent is sufficiently performed by merely maintaining the thermal-cracked heavy component at about 100° C. and charging the BTX solvent tot he pipe in which the thermal-cracked heavy component flows. Alternatively, a simple facility such as a dissolving vessel may be installed as required. The thermal-cracked heavy component thus obtained according to the manner which satisfies the above-mentioned conditions required in the second step, usually has a sufficient fluidity at below the boiling point of the solvent.

Treatment using a solvent in the third step, therefore, may be performed under the conditions at a temperature ranging from normal temperature up to the boiling point of the solvent used and at which said thermal-cracked heavy component is fluid enough, a pressure ranging from normal to 2 $Kg/cm^2G$, and while stirring for a period of time sufficient for the soluble components to dissolve. It is also possible to heat only said thermal-cracked heavy component in advance, subsequently adding the solvent which is kept at approximately normal temperature.

A suitable amount of the BTX solvent used in the third step is 1-5 times by weight of the thermal-cracked heavy component, i.e., (thermal-cracked heavy component/solvent) weight ratio is (1/1-5). The same reasons as those applied to the raw material refining mentioned previously are applicable to the amount of the solvent to be used here. That is, the lower and upper limits are defined because of the efficiency of the insoluble component separation and the production on economy, respectively. It is usually desirable to use 1-3 times by weight of the solvent based on the thermal-cracked heavy component.

If a solvent having a dissolving ability which is significantly poorer than BTX solvents is used in this third step, the resulting insoluble components may contain a significant amount of low-molecular-weight components which cannot be converted into mesophase with ease, thus making it difficult to obtain a homogeneous mesophase pitch. Conversely, the use of a solvent with a dissolving ability which is much higher than BTX solvent, results not only in decrease in the yield of the insoluble component obtained, but also in inclusion of high-molecular-weight components in the soluble components. This type of soluble component, if circulated to the first step for heat treatment, will give rise to formation of undesirable components such as a quinoline-insoluble component.

Separation and recovery of the insoluble components can be carried out using any suitable method, including sedimentation, liquid cyclone, centrifugation, filtration, and the like, with a preferable method of separation being that by which continuous operation is possible. The separated and recovered insoluble components may optionally and repeatedly be washed with a BTX solvent. Although a target mesophase pitch can be obtained by the process of the present invention without employing a washing step, less than two times of washing is preferable in order to eliminate as much components as possible which can only be converted into mesophase in a slow rate. The separation and recovery of the insoluble components may desirably be carried out at a temperature below the boiling point of the solvent used. Usually, a temperature near normal temperature brings about a sufficient result. There is no specific restriction to the combination of the solvent used in this third step and that used in the raw material refining. The use of the same solvent is, however, preferable.

The insoluble component obtained in the third step, i.e., a high-molecular-weight bituminous material, usually contains a quinoline-insoluble component below 1 wt %, and a xylene-insoluble component above 40 wt %, preferably above 50 wt %, and is optically isotropic. A part of BTX-solvent-soluble component may be present in this high-molecular-weight bituminous material. These are the heavy oils containing components with relatively low-boiling points near the temperature at which the distillation or flashing operation in the second step has been set. Therefore, most part of such components can easily be removed by means of vacuum distillation, thermal treatment, or the like. If a BTX-solvent-insoluble component is obtained from a high-softening-point pitch prepared by the distillation of the heat-treated Heavy Oil at a temperature above 350° C. which is higher than the range defined in the second step as mentioned previously, all the soluble components remaining due to insufficient washing are high-boiling-point materials which have not been removed by distillation at the high temperature. Thus, heat treatment at such a high temperature is not economical, since eliminating these soluble components in succeeding treatments by evaporation or distillation is not easy and requires a thorough washing. The BTX-insoluble component obtained from such a high-softening-point pitch (i.e., outside of this embodiment) and the high-molecular-weight bituminous material obtained in the third step of the process according to this embodiment of the present invention differ from each other in respect of the compositions and characteristics of BTX-solvent-soluble component remaining in each of these materials. This is one of the feature of the present invention.

When the high-molecular-weight bituminous material obtained in this third step is thoroughly washed until its content of xylene-insoluble component becomes almost 100%, it is impossible to measure its softening point by Mettler method because its softening point will be more than 350° C. The softening point will be approximately 150°-300° C. when the xylene-insoluble content is 60-80 wt %. These high-molecular weight bituminous materials still exhibit optically isotropic structure, and do not provide a mesophase pitch with almost complete anisotropy, even when heated for short periods to melt at a temperature of less than 400° C. and cooled.

The next fourth step comprises removing the solvent by distillation from the mother liquor, i.e., solvent solution of soluble component, obtained by the elimination of insoluble components in the third step, and optionally distilling off the surplus light fraction remaining in the mother liquor, as required, thus recovering soluble components. Operation of this fourth step comprises usual distillation and does not require any special technique. The soluble component obtained in the fourth step has a specific composition, with its lower side boiling point being determined by the conditions of distillation or flashing in the second step, and its higher side boiling point being limited by the degree of elimination of insoluble components in a BTX solvent in the third step. This soluble component is essentially the same material as the Refined Heavy Component to be charged into the first step in that it does not substantially contain any undesirable BTX-insoluble material, does contain not less than 10 wt %, preferably not less than 20 wt %, of a light fraction boiling in a range of 200°-350° C., and has a viscosity at 100° C. of below 1,000 cSt.

According to the process of the present invention, the soluble component obtained in this fourth step is continuously recycled to the first step for heat treatment to produce an additional BTX-insoluble component. The following illustrative example demonstrates the fact that the soluble component obtained in the fourth step can be a suitable raw material for the first step, and that the carbon fibers obtained therefrom has an excellent characteristics.

A pitch was obtained by removing a light fraction with a boiling point of 280° C. or lower from a commercially available coal tar. To this pitch was added twice by weight of xylene (pitch/xylene weight ratio is ½) and mixed to obtain an insoluble material, and after removal of the insoluble material by filtration, the filtrate was distilled to remove xylene and obtain a refined heavy component. The refined heavy component was heat-treated in a tubular heater having a structure, in which a heating tube with internal diameter of 6 mm and 40 m-length was dipped in a molten salt bath, under the conditions of a temperature of 520° C., pressure of 20 $Kg/cm^2G$, and raw material charge rate of 17.5 kg/hr. The product of the heat treatment was subjected to distillation at 280° C. under normal pressure to obtain a thermal-cracked heavy component. Xylene twice by weight was added to this thermal-cracked heavy component (heavy component/xylene weight ratio is ½) and mixed to dissolution, followed by continuous centrifugation of the produced insoluble component. The separated insoluble component was washed again through mixing and dispersion in xylene of twice by weight, and centrifugation. The amount of the high-molecular-weight bituminous material obtained by drying this insoluble component under vacuum was 11.1 wt % based on the amount of the refined heavy component. A soluble component obtained by distilling off xylene from the mother liquor, i.e., solvent solution of soluble component, was submitted to the heat treatment, distillation, collection of insoluble components, and drying in vacuo in the same condition as mentioned above, to yield a high-molecular-weight bituminous material in the amount of 8.4 wt % of the soluble component. Each of the high-molecular-weight bituminous materials were dissolved in a hydrogenated anthracene oil of three times by weight (bituminous material/hydrogenated anthracene oil weight ratio is ⅓), and heat-treated in a tubular heater having a structure, in which a heating tube with internal diameter of 10 mm and 100 m-length was dipped in a molten salt bath, under the conditions of a temperature of 440° C., pressure of 50 $Kg/cm^2G$, and raw material charge rate of 6.5 kg/hr. The heat-treated materials were subsequently submitted to flashing distillation under normal pressure at 400° C. to remove the solvent and light fraction therefrom to obtain hydrogenated pitches. Each of the pitches thus obtained was heat-treated in a flask at 450° C., while blowing nitrogen gas at a rate of 80 l/min per kilogram of pitch, to produce spinning pitches having a Mettler method softening point of approximately 300° C. Carbon fibers were prepared from each of the pitches. The characteristics of the carbon fibers carbonized at 1,000° C. were measured, and it was confirmed that the tensile strength of the carbon fiber derived from the original refined heavy component was 289 $kg/mm^2$, whereas that derived from the soluble component had a tensile strength of 303 $kg/mm^2$.

The same comparative test was conducted using another coal tar, with the result being that the carbon fiber prepared from the original refined heavy component had a tensile strength of 300 $kg/mm^2$ and that obtained from the soluble component had a tensile strength of 317 $kg/mm^2$. It can be recognized that by using the additionally produced BTX-insoluble component through heat treatment of the soluble component, carbon fibers with better characteristics can be obtained.

This finding has led to the recognition that the construction of the present invention is remarkably effective in promoting the yield of spinning pitches and in producing carbon fibers with good characteristics.

The amount to be recycled to the first step is preferably equivalent to or more of, particularly preferably 2–6 times of, the raw material, the Refined Heavy Component on weight basis. The amount to be recycled has a significant effect on the yield of the high-molecular-weight bituminous material, the raw material for hydrogenation treatment, produced from the unit weight of the raw material, i.e., the Refined Heavy Component. Too small a recycle ratio will not result in a significant increase in the yield. The amount of the soluble component obtained in the fourth step is dependent upon the amount of the BTX-insoluble component produced in the first step heat treatment and the amount of the light fraction eliminated in the second step. Thus, the maximum amount to be recycled can be automatically determined by these factors. It is not always necessary to recycle all the amount. The recycled amount can be arbitrarily selected from the amounts below the maximum possible amount which is determined by the conditions used and the raw material used. A particularly desirable amount of recycle is 2–6 times by weight based on the Refined Heavy Component, i.e., fresh feed, in view of the improvement in yield and the process efficiency.

Now, this effect to increase the yield of the high-molecular-weight bituminous material, which, in turn, brings about increase in the yield of spinning mesophase pitches, is exemplarily illustrated.

A thermal-cracked heavy component was obtained by submitting the above mentioned refined heavy component obtained from a commercially available coal tar to heat treatment in a tubular heater having a structure, in which a heating tube with internal diameter of 6 mm and 27.5 m-length was dipped in a molten salt bath, under the conditions of a temperature of 510° C., pressure of 20 $Kg/cm^2G$, and raw material charge rate of 12.0 kg/hr, and subsequently, to distillation under normal pressure at 280° C. An insoluble component produced from this thermal-cracked heavy component by adding and mixing xylene of twice by weight was recovered by continuous centrifugation. The insoluble component thus obtained was washed with xylene of twice by weight, dried to remove xylene to obtain a high-molecular-weight bituminous material at an yield of 7.8 wt % based on the refined heavy component. Separately, the same refined heavy component was submitted to heat treatment under the same conditions as above to collect an insoluble component, and, at the same time, a soluble component was recovered by distilling off xylene from the mother liquor free of the insoluble component. Continuous operation was conducted by recycling this soluble component to the tubular heater at a ratio of 3 times by weight of the refined heavy component. The feed rate of the refined heavy component and the amount of the recycled soluble component were 3.0 kg/hr and 9.0 kg/hr, respectively, and thereby maintaining the residence time in the tubular heater as identical with the case mentioned just above, i.e., charging the refined heavy component alone in a rate of 12 kg/hr. The amount of the high-molecular-weight bituminous material obtained from the insoluble component in this operation, through washing with xylene of twice by weight and drying, was 31.0 wt % based on the amount of the original refined heavy component, i.e., fresh feed. This amount is four times of the amount of the high-molecular-weight bituminous material obtained without recycling the soluble component. The fact that the yield of the high-molecular-weight bituminous material is four times when the recycled amount is 3 times by molecular-weight bituminous material can be obtained from the soluble component. This could not be expected from the result of the experiment in which the soluble component was independently heat-treated, because as mentioned before, when the yield of the insoluble component from the refined heavy component is 11.1 wt %, recycling solely of the soluble component gives an yield of the insoluble component of only 8.4 wt %. It was possible further to increase the amount of the soluble component recycled in the above operation further to increase the yield of the high-molecular-weight bituminous material, since there was a 23 wt % surplus of the soluble component as against the amount of the refined heavy component. In this way, the yield of the high-molecular-weight bituminous material to be directed to hydrogenation can be largely increased according to the process of the present invention.

As previously mentioned, heat treatment and recovery of insoluble components can be continuously carried out through the all steps 1–4 of the present invention, while recycling the soluble component from the fourth step to the first step. In this operation, the insoluble component obtained in the third step, i.e., the high-molecular-weight bituminous material, is subjected to hydrogenation treatment in succession.

It is necessary to hydrogenate this high-molecular-weight bituminous material by heat treatment in the presence of a hydrogen-donating solvent, since this material is difficult to be catalytically hydrogenated with hydrogen gas under an increased pressure. Also, as the high-molecular-weight bituminous material obtained in the third step contains some amounts of BTX solvent used in the third step, it is desirable to eliminate it. Such elimination can be effected by any means, including a simple evaporation with heating or distillation under a reduced or normal pressure. There is no specific limitation to the timing of the elimination. It may be performed before mixing the high-molecular-weight bituminous material with a hydrogen-donating solvent. Alternatively, a paste-like insoluble component, having the BTX solvent being contained therein, is first mixed with the hydrogen-donating solvent, and then the BTX solvent is selectively eliminated from the mixture.

The hydrogenation of the high-molecular-weight bituminous material such as pitches by the use of a hydrogen-donating solvent may be conducted in any suitable manner such as those disclosed in Japanese Patent Laid opens No. Sho 58(1983)-196292, No. Sho 58(1983)-214531 and No. Sho 58(1983)-18421. Since the use of a catalyst necessitates a catalyst separation process, it is preferable in view of the economy to conduct the hydrogenation reaction without catalyst. The hydrogen-donating solvents usable for the reaction include tetrahydroquinoline, tetralin, dihydronaphthalene, dihydroanthracene, hydrogenated wash oils, hydrogenated anthracene oils, and partially hydrogenated light fractions of naphtha tars, pyrolysis tars, and the like. As stated above, when selecting a hydrogen-donating solvent to be used, it is necessary to consider the dissolving ability of the hydrogen-donating solvent against the high-molecular-weight bituminous material obtained in the third step, carefully. From the viewpoint of the ability to dissolve the high-molecular-weight bituminous materials, tetrahydroquinoline, hydrogenated wash oils, and hydrogenated anthracene oils are preferable.

Hydrogenation may be carried out in a batch-type system, using apparatus such as an autoclave, under pressure naturally occurring in the reaction. Use of a batch-type system, however, involves difficulty in controlling the temperature as the apparatus becomes larger, and at the same time, tends to enlarge the temperature difference between the outer side and center of a vessel, thus causing formation of coke-like solid materials during hydrogenation treatment. Since it is not easy to remove these solid materials by means of filtration, or the like after completion of hydrogenation, use of the process free from solid material formation during hydrogenation is recommended. One of the desirable processes is to continuously hydrogenate the high-molecular-weight bituminous material in the presence of 1-5 times by weight of a hydrogen-donating solvent in a tubular heater at a temperature of 350°-500° C., preferably 400°-460° C. and pressure of 20-100 $Kg/cm^2G$. This process of hydrogenation not only ensures the efficiency by virtue of its continuous operation, but also makes it possible to hydrogenate the high-molecular-weight bituminous material without formation of coke-like solid material. A desirable amount of the solvent used is 1-5 times by weight of the high-molecular-weight bituminous material, as mentioned just above, since the hydrogenation can be performed effectively and economically enough with this amount of the solvent. The residence time may usually be in a 10-120 min range at a temperature of 400°-460° C.

The hydro-treated liquid thus obtained can be sent directly to the step of heat treatment to convert it into mesophase pitch or alternatively, as described below, the hydro-treated liquid can be sent to a distillation apparatus or flasher to remove the hydrogen-donating solvent and light fractions contained therein.

That is, a hydrogenated pitch is obtained by removing the solvent from the hydrogenated mixture, i.e., hydro-treated liquid, by any arbitrary means such as distillation, or the like. This is performed by a conventional distillation unit of either batch- or continuous-type. However, since the high-molecular-weight bituminous material continuously obtained in the third step of the process of the present invention contains a relatively low-boiling-point fraction which is soluble in a BTX solvent, it is desirable to subject the hydro-treated liquid to continuous flash distillation under a pressure of 0-3 $Kg/cm^2A$ and temperature of 300°-530° C. By doing so, the solvent, low-boiling-point fraction contained in the high-molecular-weight bituminous material, and light fraction formed during the hydrogenation treatment can be simultaneously separated and removed, and recovering a hydrogenated pitch from the bottom of the flashing column. A substantially optically isotropic hydrogenated pitch having a softening point of 100°-200° C., and containing a quinoline-insoluble component below 1 wt % and xylene-insoluble component above 40 wt % can be continuously produced according to this process. When other type of process is employed to conduct the hydrogenation and solvent removal, it is desirable to perform the process so as to obtain a hydrogenated pitch having the aforementioned properties. Discussions have already been made on the quinoline-insoluble component. As to the xylene-insoluble component, too small an amount of this component requires very severe heat treatment conditions to obtain a mesophase content of more than 90 wt %, so that the treatment involves formation of a large amount of the quinoline-insoluble component. Submitting the material containing a large amount of a residual solvent or light fraction to the next heat treatment makes the volume to be treated larger, and thus is not desirable. The softening point range of a hydrogenated pitch which satisfies these conditions is between 100° C. and 200° C.

Although sending a hydro-treated liquid containing the hydrogen-donating solvent used to the step of heat treatment for the production of mesophase pitch is not preferable for the reason that it increases the amount to be treated in the step, there are merits to save a facility such as a distillation column and a treating step for removal of the solvent. Especially, when a mesophase pitch is prepared by using the continuous dispersion-heat-treating process described in the first embodiment of the present invention, removal of solvent and light fractions can be effected readily and rapidly, and can be handled a large amount of feed with ease, and therefore, in this case, a hydro-treated liquid can be sent directly to the step of heat treatment for the preparation of mesophase pitch without subjecting a distillation operation, or the like.

The hydro-treated liquid, or the hydrogenated pitch which has been obtained from the hydro-treated liquid by removal of the solvent and light fractions, is then subjected to the final heat treatment. As to the process for conducting this heat treatment, the process described in detail relative to the first embodiment of the present invention can preferably be used. It is possible, however, that conversion into a mesophase pitch can be conducted by conventional processes, for example, the treatment can be carried out under a reduced pressure or normal pressure while blowing an inert gas at a temperature of 350°-500° C. for 10-300 min, with preferable ranges being 380°-480° C. and 10-180 min. The hydrogenated pitch may also be continuously heat-treated using a thin-film evaporator or flow-down film type heat treatment apparatus under a reduced or normal pressure while passing an inert gas at a temperature of 350°-500° C.

During this heat treatment, the hydrogenated bituminous material, i.e., hydrogenated pitch, which is substantially isotropic can be transformed into a mesophase pitch exhibiting anisotropy in its entirety or near entirety.

in summary, when using the high-molecular-weight bituminous material obtained by the process of the present invention, the bituminous material can be readily transformed into entirely anisotropic mesophase pitch, since the material is prepared by a specific procedure and under specific conditions, and is thus composed of stringently selected components. The process of the present invention can provide a mesophase pitch having especially high homogenuity and having the following four required characteristics which have never been satisfied by any one of pitches prepared by known conventional processes; that is, (1) a low-softening point, (2) a high mesophase content, (3) a low content of quinoline-insoluble components, and (4) a low content of xylene-soluble components.

The processes of the present invention are now illustrated with reference to FIG. 2.

Figure 2:
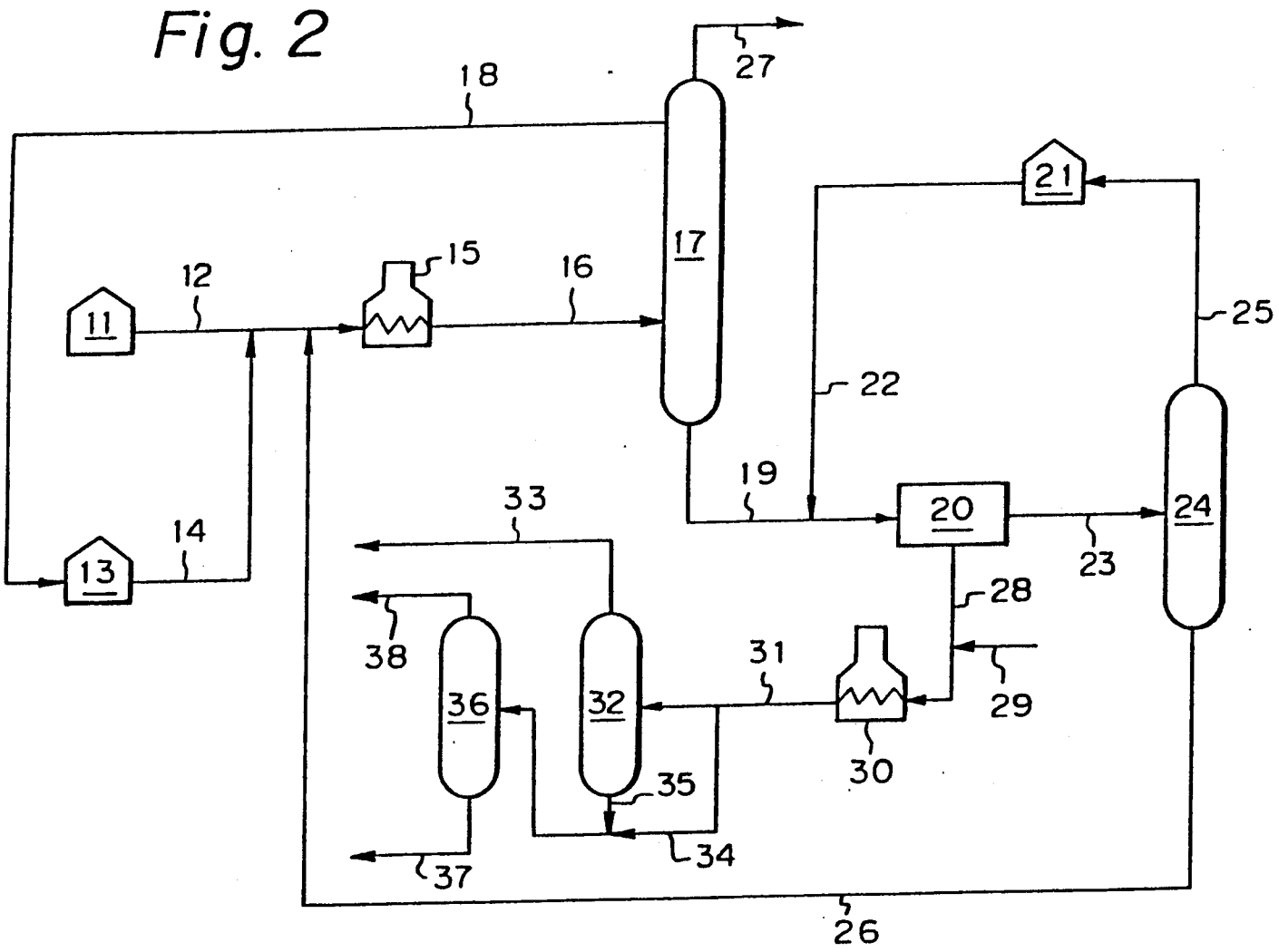
FIG. 2 is a simplified, schematic flow-diagram to show the flow of the second embodiment of the present invention.

In FIG. 2, the number 11 designates the tank for storing a Refined Heavy Component. The Refined Heavy Component is fed to the tubular heater 15 through line 12. At this time, an aromatic oil from the aromatic oil tank 13 may be fed to line 12 via line 14, and blended to dilute the Refined Heavy Component, as required. The liquid heat-treated in the tubular heater 15 is charged into the distillation column 17 through the line 16. The light fraction is taken out from the system at the top of the distillation column 17 via line 27. The thermal-cracked heavy component is obtained as the bottom fraction. When the aromatic oil is used as a diluent in heat treatment in the tubular heater 15, this is eliminated in the distillation column 17 as a fraction and returned to the tank 13 via line 18. The thermal-cracked heavy component which is the bottom fraction of the distillation column 17 is sent to the insoluble component separator 20 via line 19, a BTX solvent is sent from the BTX solvent tank 21 via line 22 and blended with the thermal-cracked heavy component. A blending tank may be provided before the insoluble component separator 20 and after the junction point of lines 19 and 22. The mixture of the thermal-cracked heavy component and BTX solvent is sent to the insoluble component separator 20, wherein the solvent-insoluble component, i.e., the high-molecular weight bituminous material, is separated and recovered via line 28. The mother liquor remained after removal of the insoluble component is sent to the solvent recovery column 24 through line 23, where the solvent is recovered and sent back to the BTX solvent tank 21 via line 25. On the other hand, the soluble component obtained as the bottom fraction of the solvent recovery column 24 is recycled to the line 12 via line 26 for further heat treatment. When only a portion of the recovered solvent-soluble component is recycled, the component not recycled may be taken out from the system as by product from any desired point of line 26. The high-molecular-weight bituminous material recovered via line 28 is mixed with a hydrogen-donating solvent fed through line 29, and the mixture is fed to a hydrogenation reactor 30. The hydrogenation reactor effluent, i.e., a hydro-treated liquid, is sent to a distillation column 32 via line 31 and is distilled therein so as to remove spent hydrogen-donating solvent and light fractions via line 33. A hydrogenated pitch is obtained from the bottom of the distillation column 32 via line 35 and is sent to a heat-treating apparatus 36 for the final heat treatment to convert the hydrogenated pitch into a mesophase pitch. Alternatively, the hydro-treated liquid can be bypassed the distillation column 32 by passing through a bypass line 34. A mesophase pitch produced within the heat-treating apparatus 36 is recovered via line 37. Light fraction or a mixture of the light fraction and spent hydrogen-donating solvent is vented from the overhead of the heat-treating apparatus 36 is recovered via line 37. Light embodiments, the heat-treating apparatus 36 is a continuous dispersion-heat-treating apparatus fully described in connection with the first embodiment. In the fourth embodiment, the heat-treating apparatus 36 is not limited to the continuous dispersion-heat-treating apparatus, and any suitable type reactor such as an autoclave, film evaporator, and the like can be employed. In the third embodiment, the soluble component obtained from the solvent recovery column 24 is not recycled to line 12, and is recovered directly from the system.

FIG. 2 is drawn in a simplified manner in order to schematically illustrate the features of the present invention, and shall not be construed as limiting the present invention. It is possible to change the apparatus or its combination without departing from the essential features of the present invention. For instance, a flashing column or flashing drum may be employed in place of the distillation column 17 in the second step, removing a portion of a light fraction in this flashing column or drum, and providing a fractionation column instead of the solvent recovery column 24 in the fourth step, simultaneously to conduct recovery of the solvent and remaining portion of the light fraction in this fractionation column.

In the above, descriptions are made mainly relative to the second and fourth embodiments of the present invention. It is apparent that the third embodiment of the present invention can be derived from the second embodiment by simply eliminating the requirement of the fourth step and also eliminating the requirement to recycle the soluble component obtained in the fourth step to the first step.

When considering from other view point, the essential parts of the fourth embodiment of the present invention stipulates an excellent process for the preparation of a raw material which is especially suitable for use in the process of the first embodiment.

In the present invention, quantitative analysis of xylene-, quinoline- and pyridine-insoluble components were carried out according to the following method.

One (1) g of sample was weighed in a centrifugal precipitation tube, to which 30 cc of a solvent (xylene, quinoline or pyridine) was added. The tube was dipped into a water bath maintained at 80° C., at which temperature its content was agitated for about 1 hr to dissolution. The tube was then taken out from the bath, and after being cooled to room temperature, was subjected to centrifugation at 5,000 rpm for 10 min. The supernatant in the centrifugal precipitation tube was carefully removed by an injector. To this centrifugal precipitation tube 30 cc of the solvent was again charged and agitated in the bath at 80° C. for 30 min to wash and disperse the precipitate. The tube was then taken out from the bath and centrifuged at room temperature, and the supernatant was removed by an injector. The addition of 30 cc of the solvent, washing, dispersion, and centrifugation were repeated once more. The supernatant was removed from the tube and the residua insoluble component in the tube was washed away therefrom with xylene, and subjected to filtration by means of suction in a G-4 glass filter. The residue remained in the glass filter was washed twice with about 10 cc of xylene and subsequently once again with 10 cc of acetone, dried in a dryer at 110° C., and finally weighed.

The process of the present invention comprises recovering a BTX-insoluble component which is produced when a Refined Heavy Component having substantially no BTX-insoluble material is subjected to heat treatment under specific conditions, and using this recovered BTX-insoluble component as a raw material of a mesophase pitch. The process ensures the production of a very homogeneous mesophase pitch with a low-softening point, which any conventional processes have never been able to produce. Furthermore, carbon fibers having exceptionally excellent characteristics can be prepared from this mesophase pitch. The mesophase pitch obtained according to the process of the present invention is clearly distinguished from conventional mesophase pitch in that it can satisfy the following six characteristics at the same time. That is, the mesophase pitch has (1) a low softening point (Mettler method softening point of below 310° C.), (2) a high mesophase content (above 90 wt %), (3) a low quinoline-insoluble content (below 10 wt %), (4) a low xylene-soluble content (below 10 wt %), (5) a relatively high pyridine-insoluble content (above 25 wt %), and (6) can be prepared into a high-performance carbon fiber, which, when carbonized at 1,000° C., has a tensile strength of above 300 kg/mm$^2$, and when graphitized at 2,500° C. has a tensile strength of above 400 kg/mm$^2$ and modulus of elasticity of above 60 ton/mm$^2$.

In addition, by adopting specific treatment conditions, it is possible to recover the soluble component having the same properties as the raw material, i.e., the Refined Heavy Component. Thus, a remarkable promotion of the yield of the high-molecular-weight bituminous material, i.e., a raw material for hydrogenation treatment can be realized by recycling this recovered soluble component. Since this recycling is performed continuously, a high degree of efficiency can also be materialized by the process of the present invention. Furthermore, since the process employs as a raw material, i.e., a Refined Heavy Component which is substantially free from a BTX-insoluble material and treats this raw material under the specific conditions and using the specific process, the process can prevent formation of coke-like solid materials in all steps for the preparation of a mesophase pitch. Therefore, steps for eliminating these solid materials are not always needed in the process. This brings about significant efficiency of the process.

in addition, the properties of the high-molecular-weight bituminous material to be directed to hydrogenation and the properties of the mesophase pitch can be controlled easily, since all the high-molecular-weight bituminous materials are artificially prepared according to the process of the present invention. This means that the process of the present invention can well cope with fluctuations of the raw material properties. Thus, the process not only is efficient but also possesses an abundant flexibility. Carbon fibers having remarkable characteristics can be produced from the mesophase pitch obtained by the process of the present invention.

DESCRIPTION OF THE PREFERRED EMBODIMENT

The present invention is hereafter described more materially by way of Examples. In the description of Examples below, designations of "%", "times" and "parts" mean "% by weight", "times by weight" and "parts by weight", respectively, unless otherwise specified. Distillation temperature used herein means column-top temperature unless otherwise specified.

EXAMPLE 1

A commercially available coal tar (A) with the properties shown in Table 2 was distilled at 280° C. to remove the light fractions therefrom, thereby obtained a pitch. To the pitch thus obtained twice by weight of xylene (i.e., 1 part of pitch/2 parts of xylene) was added and mixed to dissolution. The mixture was then submitted to a continuous filter (a Leaf Filter manufactured by Kawasaki Heavy Industries, Ltd.) to separate insoluble materials at normal temperature. Xylene was subsequently distilled off from the filtrate, thus obtaining a refined heavy component with the properties shown in Table 2. The yield of refined heavy component based on the coal tar was 69.7%.

A mixture of 1 part by weight of this refined heavy component and 0.75 part by weight of a wash oil, which was a 240°-280° C. fraction of coal tar, was subjected to a continuous heat treatment in a tubular heater at a temperature of 510° C., pressure of 20 Kg/cm$^2$G, and residence time of 240 sec, followed by flash distillation at 280° C. to eliminate the wash oil and thermal-cracked light fractions produced, while taking out a thermal-cracked heavy component from the bottom of the flashing column. To this thermal-cracked heavy component, xylene of twice by weight (1 part of the heavy component/2 parts of xylene) was added and mixed to dissolution, and the insoluble component thus formed was separated by a centrifuge (Mini-Decanter manufactured by Ishikawajima Harima Heavy Industries, Ltd.). The separated insoluble component was dispersed in xylene of twice by weight, again centrifuged, and washed. Xylene was removed from this xylene-insoluble component to obtain a high-molecular-weight bituminous material. The yield of the high-molecular-weight bituminous material based on the refined heavy component was 8.5%.

Hydrogenation treatment of this high-molecular-weight bituminous material was performed by mixing and dissolving this material with hydrogenated anthracene oil of three times by weight (1 part of the bituminous material/3 parts of hydrogenated anthracene oil) and heat-treating the mixture in a tubular heater under the conditions of 440° C., 50 Kg/cm²G, and residence time of 73 min. The hydro-treated liquid obtained by this heat treatment in the tubular heater was used as the raw material for continuous dispersion-heat-treating process of the present invention.

The continuous treatment apparatus used for the preparation of the mesophase pitches had the construction as shown in FIG. 1. The dimensions were as follows: Internal diameter of the vessel was 100 mm, distance between one collecting pan and the next collecting pan was 130 mm, diameter of each rotating disk is 70 mm, diameter of the hole at the lower end of each collecting pan was 40 mm, combinations of collecting Pan and disk were five-stages, and the disks were fixed at a 60 mm-distance from the upper end of each collecting pan, i.e., from the flange.

Several continuous treatment experiments were carried out using this apparatus at a raw material feed rate of 6.5 kg/hr, rotating speed of the rotating disk of 230–700 rpm, nitrogen feed rate of 30–80 l/min, temperature of 440°–480° C., and under normal pressure. The operating conditions and the characteristics of the pitches produced are shown in Table 3.

Experiment No. 7 in Table 3 represents a 15-hour continuous operation. In this experiment, the softening points of the product pitch measured at 30-min interval were 303° C. at all measurements. Thus, pitches having a constant property were obtained in an operation extending over a long period of time. After completion of the operation, the apparatus was cooled, disassembled, and submitted to inspection. No coke formation was found any place of the vessel.

When observed by a polarizing microscope, the pitches obtained in Experiment Nos. 2–7 exhibited complete anisotropy, and the pitch obtained in Experiment No. 1 exhibited about 80% anisotropy, evidencing that they were mesophase pitches. Further, pyridine-insoluble content of the mesophase pitch obtained in Experiment No. 2 was 41.3%. The pitch obtained in Experiment 4 was spun using a spinning apparatus having a nozzle hole diameter of 0.25 mm and hole length of 0.75 mm at a temperature of 332° C. and a winding speed of 700 m/min. The product was heated at 320° C. for 20 min in an air to cause its infusion, followed by carbonization in a nitrogen stream at 1,000° C. to obtain a carbon fiber. The carbon fiber had a diameter of 8.0 μ, tensile strength of 292 kg/mm² and modulus of elasticity of 16.4 ton/mm².

TABLE 2

| | Coal tar | Refined Heavy Component |
|---|---|---|
| Specific gravity | 1.164 | 1.181 |
| Viscosity (cSt. at 100° C.) | 5.1 | 28.3 |
| Xylene insolubles (wt %) | 0.6 | 1.9 |
| Quinoline insolubles (wt %) | 4.7 | less than 0.1 |
| Distillation (°C.) | | |
| IBP | 189 | 220 |
| 10 vol % | 221 | 304 |
| 30 vol % | 322 | 372 |
| 50 vol % | 401 | 439 |

TABLE 3

| Experiments No. | 1 | 2 | 3 | 4 | 5 | 6 | 7 |
|---|---|---|---|---|---|---|---|
| Treating tem. (°C.) | 440 | 460 | 480 | 460 | 460 | 460 | 449 |
| Nitrogen feed rate (l/min) | 30 | 30 | 30 | 50 | 50 | 50 | 80 |
| Nitrogen feed rate per raw material ($m^3$/kg) | 0.61 | 0.63 | 0.65 | 1.05 | 1.05 | 1.05 | 1.67 |
| Gas velocity (m/sec) | 0.3 | 0.3 | 0.3 | 0.5 | 0.5 | 0.5 | 0.9 |
| Rotating rate (rpm) | 700 | 700 | 700 | 700 | 520 | 230 | 700 |
| ($V^2$/R) (m/sec²) | 94.4 | 94.4 | 94.4 | 94.4 | 47.8 | 10.2 | 94.4 |
| Yield of pitch (wt %)* | 16.9 | 16.2 | 15.9 | 15.7 | 15.6 | 15.9 | 15.4 |
| Properties of pitch | | | | | | | |
| Mettler Method softening point (°C.) | 287 | 298 | 301 | 302 | 303 | 304 | 303 |
| Xylene insolubles (wt %) | 86.0 | 93.7 | 95.5 | 94.8 | 95.0 | 95.5 | 94.6 |
| Quinoline insoluble (wt %) | 0.1 | 2.1 | 9.5 | 3.6 | 3.5 | 3.9 | 3.7 |

*Yield based on the hydro-treated liquid.

EXAMPLE 2

A commercially available coal tar (B) with the characteristics listed in Table 4 was distilled at 280° C. to remove a light fraction and obtain a pitch. To the pitch thus obtained was added two times of xylene and mixed to dissolution. An insoluble material produced was removed by filtration at normal temperature using a continuous filter (a Lead Filter manufactured by Kawasaki Heavy Industries, Ltd.). The filtrate obtained was distilled to remove xylene to obtain a refined heavy component at an yield of 70.0% based on the raw coal tar.

A process comprising the first step of heat treatment through the fourth step of soluble component recovery as shown in FIG. 2 was continuously carried out using this refined heavy component as the raw material. Operating conditions used in each step were as follows:

| | |
|---|---|
| First step | |
| Amount of feed | |
| Refined heavy component: | 3 kg/hr |
| Recycled amount of soluble component: | 9 kg/hr |
| Total: | 12 kg/hr |
| Recycle ratio: | 3 |
| Tubular heater | |
| Construction: | |
| A heating tube with internal diameter of 6 mm and length of 27.5 m. The tube was dipped in a molten salt bath. | |
| Heating tube outlet temperature: | 510° C. |
| Heating tube outlet pressure: | 20 Kg/cm²G |
| Second step | |
| Distillation column | |
| Temperature: | 280° C. |
| Pressure: | Normal pressure |
| Third step | |
| Solvent: | Xylene |
| Solvent ratio: | Two times of the bottom fraction of the second step distillation column (thermal-cracked heavy component) |
| Method for mixing of solvent and the thermal-cracked | Into a pipe in which thermal-cracked heavy component flows at a temperature of about 100° C. under normal pressure, two |

-continued

| | |
|---|---|
| heavy component: | times of xylene (based on the amount of the thermal-cracked heavy component) was continuously added and mixed, and then the mixture was cooled to room temperature by a cooler. |
| Separation of the insoluble component | |
| Separator: | Mini-Decanter manufactured by Ishikawajima Harima Heavy Industries, Ltd. |
| Conditions: | Room temperature, normal pressure |
| Fourth step | |
| Solvent recovery column | |
| Top temperature: | 145° C. |
| Bottom temperature: | 210° C. |
| Pressure: | Normal pressure |

The insoluble component obtained in the third step of the operation was 94.5% based on the refined heavy component. The insoluble component thus recovered, which contained some amount of xylene and xylene-soluble component, was dispersed again in two times of xylene to conduct washing and subjected to centrifugation at normal temperature using the same centrifugal machine as previously mentioned, to recover a washed insoluble component. Xylene was eliminated from the washed in soluble component thus obtained by heating under a reduced pressure to obtain the high-molecular-weight bituminous material of the present invention. This material was obtained at an yield of 31.0% on the amount of the refined heavy component, contained 74.7& of xylene-insoluble component and 0.2% of quinoline-insoluble component, and was completely isotropic. Products produced in each step were sampled during operation and subjected to analysis, the results of which are listed in Table 5. Subsequently, the high-molecular-weight bituminous material was mixed with 3 times of hydrogenated anthracene oil to dissolution and the mixture was submitted to continuous hydrogenation treatment in a tubular heater, of which heating tube having an internal diameter of 10 mm and length of 100 m and being dipped in a molten sat bath, under the conditions of a temperature of 440° C., pressure of 50 Kg/cm$^2$G, and residence time of 73 min. The hydro-treated liquid was immediately sent to a flashing column and submitted to flashing distillation at normal pressure and a temperature of 400° C. to obtain a hydrogenated pitch. The hydrogenated pitch was obtained at an yield of 86.8% based on the amount of the hiqh-molecular-weight bituminous material, had a softening point of 139° C. (by JIS Ring and Ball method), and contained 56.2% of xylene-insoluble component and 0.2% of quinoline-insoluble component.

This hydrogenated pitch was charged into a polymerization flask and heat-treated while blowing nitrogen gas at a rate of 80 l/min (per 1 kg of the hydrogenated pitch) at normal pressure in the molten salt bath at a temperature of 450° C. for 45–55 min. The mesophase pitch obtained had properties as listed in Table 6. The yields of the mesophase pitch based on the hydrogenated pitch were 74% for Experiment No. 8 and 72% for Experiment No. 9.

The mesophase pitch obtained in Experiment No. 9 of Table 6 was spun with a spinning apparatus having a nozzle with hoe diameter of 0.25 mm and hole length of 0.75 mm at a temperature of 330° C. and winding speed of 700 m/min. The spun fiber was heated in air at a 1° C./min temperature increasing rate up to 320° C., at which temperature the fiber was heated for 20 min to infusion, and then carbonized at 1,000° C. in an nitrogen gas atmosphere, and further graphitized at 2,500° C. Characteristics of the carbon fiber thus obtained are listed in Table 7.

Further, hydrogenation treatment of the high-molecular-weight bituminous material was performed by mixing and dissolving this material with hydrogenated anthracene oil of three times by weight (1 part of the bituminous material/3 parts of hydrogenated anthracene oil) and heat-treating the mixture in a tubular heater at a temperature of 440° C. and under a pressure of 50 Kg/cm$^2$G and at a residence time of 73 min. The hydro-treated liquid obtained by this heat treatment was immediately cooled down without flash distillation and this hydro-treated liquid was used as the raw material for continuous dispersion-heat-treating process of the present invention.

Experiments were conducted to continuously prepare mesophase pitches. The continuous treatment apparatus used for the preparation of the mesophase pitches is the same as the apparatus used in Example 1 except that the disk position was changed. Conditions of the treatment and the properties of pitches obtained are shown in Table 8, in which the disk position designates a distance between the upper end of the collecting pan, i.e., the upper surface of the flange, and the upper surface of the disk.

As is clear from Table 8, pitches with almost the same properties were obtained, when the disk position was changed from 30 mm to 90 mm. Thus, it was evidenced that the disk position did not affect the properties of the pitches produced.

A carbon fiber was produced using the pitch prepared in Experiment 14 and according to the process described in Example 1. The characteristics of the carbon fiber carbonized at 1,000° C. were measured. This carbon fiber had a diameter of 7.7 μ, tensile strength of 318 kg/mm$^2$, and modulus of elasticity of 17.2 ton/mm$^2$.

TABLE 4

| Properties of Coal Tar | |
|---|---|
| Specific Gravity | 1.157 |
| Viscosity (100° C.) | 28.0 cSt |
| Xylene Insolubles | 7.2% |
| Quinoline Insolubles | 1.0% |
| Distillation | |
| IBP | 226° C. |
| 10% | 279° C. |
| 20% | 302° C. |
| 30% | 332° C. |
| 40% | 360° C. |
| 50% | 397° C. |
| 60% | 440° C. |

TABLE 5

Properties of Products

| | Refined Heavy Component (Starting Material) | Thermal-Cracked Heavy Component (Second Step) | Soluble Component (Fourth Step) |
|---|---|---|---|
| Specific Gravity | 1.162 | 1.228 | 1.184 |
| Viscosity (cSt, 100° C.) | 48.4 | 135.4 | 31.4 |
| Xylene Insolubles (%) | 0.8 | 7.4 | 1.7 |
| Quinoline Insolubles (%) | less than 0.1 | less than 0.1 | less than 0.1 |

TABLE 5-continued

| | Properties of Products | | |
|---|---|---|---|
| | Refined Heavy Component (Starting Material) | Thermal-Cracked Heavy Component (Second Step) | Soluble Component (Fourth Step) |
| Distillation (°C.) | | | |
| IBP | 248 | 235 | 233 |
| 10% | 309 | 314 | 304 |
| 20% | 329 | 342 | 329 |
| 30% | 346 | 363 | 354 |
| 40% | 366 | 381 | 373 |
| 50% | 389 | 416 | 400 |
| 60% | 420 | | |

TABLE 6

| Properties of Mesophase Pitches | | |
|---|---|---|
| Experiments No. | 8 | 9 |
| Heat-Treating Time | 45 min | 55 min |
| Properties of Pitch | | |
| Mettler method softening point | 299° C. | 302° C. |
| Quinoline insolubles | 1.1% | 3.4% |
| Xylene solubles | 6.1% | 4.9% |
| Mesophase content* | 100% | 100% |

*Area percentage exhibiting optical anisotropy when observed by polarizing microscope (applicable also to following Examples).

TABLE 7

| The Characteristics of Carbon Fiber and Graphite Fiber Prepared | | |
|---|---|---|
| | Carbonized at 1,000° C. | Graphitized at 2,500° C. |
| Diameter of fiber (μ) | 7.5 | 6.5 |
| Tensile strength (kg/mm$^2$) | 344 | 438 |
| Elongation at break (%)* | 1.90 | 0.65 |
| Modulus of elasticity (ton/mm$^2$) | 18.2 | 67.2 |

*Elongation (%) means "% by length" (applicable also to following Examples).

TABLE 8

| Experiments No. | 10 | 11 | 12 | 13 | 14 | 15 |
|---|---|---|---|---|---|---|
| Disk position (mm) | 30 | 30 | 60 | 60 | 60 | 90 |
| Treating temp. (°C.) | 450 | 460 | 450 | 460 | 470 | 460 |
| Nitrogen feed rate (l/min) | 80 | 80 | 80 | 80 | 50 | 80 |
| Rotating rate (rpm) | 700 | 700 | 700 | 700 | 700 | 700 |
| Yield of pitch (wt %) | 15.4 | 14.8 | 14.9 | 14.6 | 14.4 | 15.1 |
| Properties of pitch | | | | | | |
| Mettler Method softening point (°C.) | 298 | 303 | 298 | 303 | 306 | 303 |
| Xylene insolubles (wt %) | 91.3 | 93.2 | 90.6 | 93.4 | 94.4 | 93.6 |
| Quinoline insolubles (wt %) | 0.3 | 0.7 | 0.2 | 0.9 | 1.4 | 0.8 |

EXAMPLE 3

Several runs were conducted continuously using the same hydro-treated liquid used in Example 2 and using the apparatus described in Example 1 at a raw material feed rate of 6.5 kg/hr, temperature of 450° C., and rotating rate of 700 rpm, with the nitrogen feed rate being changed within a 30–120 l/min range. The treatment conditions and properties of pitches prepared are shown in Table 9.

As is evident from Table 9, no change in the softening point of the pitches occurred at nitrogen feed rates above 100 l/hr. Accordingly, no effect of nitrogen gas feed rate increase in excess of 100 l/hr was recognized. Experiment No. 18 in Table 9 was conducted under the same conditions as Experiment No. 12 in Table 8. The softening point of the pitches produced in both of these experiments were 298° C., demonstrating the excellent reproducibility of the process.

TABLE 9

| Experiments No. | 16 | 17 | 18 | 19 | 20 |
|---|---|---|---|---|---|
| Nitrogen feed rate (l/min) | 30 | 50 | 80 | 100 | 120 |
| Nitrogen feed rate per raw material (m$^3$/kg) | 0.63 | 1.05 | 1.70 | 2.12 | 2.54 |
| Gas velocity (m/sec) | 0.3 | 0.5 | 0.9 | 1.0 | 1.2 |
| Properties of pitch | | | | | |
| Mettler method softening point (°C.) | 286 | 291 | 298 | 300 | 300 |

EXAMPLE 4

The xylene insolubles obtained in Example 2 were mixed with 2.4 times by weight of a hydrogenated anthracene oil for dissolution, and submitted to heat treatment using a tubular heater at a temperature of 440° C., pressure of 50 Kg/cm$^2$G, and residence time of 73 min to obtain a hydro-treated liquid. The hydro-treated liquid thus obtained was used as the raw material for a continuous treatment.

The apparatus used had the same construction as that shown in FIG. 1, with the size thereof and its various parts being identical with those of the apparatus used in Example 1. Experiments were carried out using 3-, 5-, and 9-stage rotating disk-collecting pan combinations in order to investigate the influence of the number of stages on the efficiency.

Continuous treatment was carried out at a raw material feed rate of 6.5 kg/hr, disk rotating rate of 800 rpm, and nitrogen feed rate of 80 l/min, but at a different temperature for all experiments. In this way, the treatment temperature required for preparing a pitch with a Mettler method softening point of 300° C. was determined for each of the disk-collecting pan combination stages. The results obtained were that the required treatment temperatures were 469° C., 459° C., and 452° C. for the apparatus with 3-, 5-, and 9-stages, respectively. The experiments thus confirmed that a considerable decrease in the treatment temperature was possible by increasing the number of combination stages.

EXAMPLE 5

A heavy coal tar (C) with properties shown in Table 10 was used as the raw material. The heavy coal tar was obtained from a coal tar by a pretreatment in which a portion of light fractions were removed by a distillation operation at 300° C. One (1) part of the heavy coal tar was mixed with and dissolved in 2 parts of xylene, and then insoluble materials thus formed were separated and removed by a continuous filter. Xylene was removed from the filtrate by distillation and thereby obtained a refined heavy component with properties shown in Table 10. The yield of the refined heavy component was 92.1% based on the heavy coal tar.

By using the refined heavy component as the feed, the first step, i.e., a heat treatment in a first tubular heater; the second step, i.e., removal of light fractions by distillation; the third step, i.e., separation of insoluble component newly formed and mother liquor, i.e., solvent solution of soluble component, and washing of the insoluble component; and the fourth step, i.e., recovery of the soluble component from the mother liquor by removal of the solvent used with distillation, were continuously conducted in accordance with the process as illustrated in FIG. 2. The soluble component obtained in the fourth step was recirculated into the first tubular heater of the first step in a rate so as to give the soluble component/the refined heavy component weight ratio of 3/1. The operating conditions of each step were set as follows:

| | |
|---|---|
| First step | |
| Amount of the feed | |
| Refined heavy component: | 4.4 kg/hr |
| Recycled amount of soluble component: | 13.2 kg/hr |
| Recycle ratio: | 3 |
| Tubular heater | |
| A heating tube with internal diameter of 6 mm and length of 40 m dipped in a molten salt bath. | |
| Heating tube outlet temperature: | 500° C. |
| Heating tube outlet pressure: | 20 Kg/cm$^2$G |
| Second step | |
| Distillation column | |
| Packed column | |
| Temperature: | 290° C. |
| Pressure: | Normal pressure |
| Third step | |
| Solvent: | Xylene |
| Solvent ratio: | 1.5 parts/1 part of thermal-cracked heavy component obtained in the second step (bottom fraction of the distillation column) |
| Method for mixing of solvent and the thermal-cracked heavy component: | Into a pipe in which thermal-cracked heavy component flows at a temperature of about 100° C. under normal pressure, 1.5 times of xylene (based on the amount of the thermal-cracked heavy component) was continuously added and the mixture was agitated at 50° C. within a small agitating and blending tank having an average residence time of 2 min, and then cooled to room temperature by a cooler. |
| Separation and recovery of the insoluble component | |
| Separator: | Centrifuge (Mini-Decanter manufactured by Ishikawajima Harima Heavy Industries, Ltd.) |
| Conditions: | Room temperature, normal pressure |
| Washing of insoluble component | |
| One (1) part of the insoluble component obtained from the centrifuge was added, mixed and dispersed into 2 parts of xylene at room temperature, and then filtered under pressure. | |
| Fourth step | |
| Solvent recovery column | |
| Packed column | |
| Temperature: | 145° C. |
| Pressure: | Normal pressure |

The yield based on the refined heavy component of the high-molecular-weight bituminous material obtained from the insoluble component with removal of xylene by heating under a reduced pressure was 25.3%. The high-molecular-weight bituminous material had following properties: Xylene insolubles: 69.9%; quinoline insolubles: less than 0.1%. When observed by a polarizing microscope, it showed isotropy in its entirety. During this operation, samples were taken from each step and analyzed. The results were shown in Table 11.

Then, 3 parts of hydrogenated anthracene oil was added to 1 part of the high-molecular-weight bituminous material to dissolution and then heat-treated using the same conditions and the tubular heater as used in Example 2 to conduct hydrogenation, and a hydro-treated liquid was obtained. The hydro-treated liquid was flash distilled using the same conditions and flash distillation column as used in Example 2, thereby obtained a hydrogenated pitch. Yield of the hydrogenated pitch based on the refined heavy component was 23.0%. The properties of the hydrogenated pitch were as follows: Softening point (JIS Ring and Ball method): 151° C.; xylene insolubles: 55.6%; quinoline insolubles: 0.2%.

Then, the hydrogenated pitch was put into a polymerization flask as in the case of batchwise mesophase forming operation of Example 2, and heat-treated for 30 min in a molten salt bath kept at 450° C. under normal pressure while blowing a nitrogen gas stream at a rate of 8l/min, thereby obtained a mesophase pitch for the preparation of high-performance carbon fibers. Yield of the mesophase pitch based on the refined heavy component was 16.4% and the properties thereof were as follows: Mettler method softening point: 304° C.; xylene insolubles: 95.8%; quinoline insolubles: 0.7%; and pyridine insolubles: 36.8%. When observed by a polarizing microscope, mesophase content thereof was about 100%.

The mesophase pitch was spun by using the spinning apparatus as used in Example 1 at a temperature of 330° C. and winding rate of 700 m/min, and the spun fiber was rendered infusible under the same condition as used in Example 1 and the fiber was carbonized at 1,000° C. Characteristics of the carbon fiber were as follows: Tensile strength: 315 kg/mm$^2$; modulus of elasticity: 17.8 ton/mm$^2$. Further, the carbon fiber was graphitized at 2,500° C. in a nitrogen atmosphere. The characteristics of the graphite fiber thus obtained were as follows: Tensile strength: 421 kg/mm$^2$; modulus of elasticity: 62.8 ton/mm$^2$.

Further, hydro-treated liquid obtained by hydrogenation of the high-molecular-weight bituminous material at a temperature of 440° C. under a pressure of 50 Kg/cm$^2$G in a tubular heater as stated above was cooled to about 100° C. without sending it to the flash distillation column. The hydro-treated liquid was heat-treated by using the continuous dispersion-heat-treating apparatus with the construction as described in Example 1, except that numbers of combination of collecting pans and disks were 8.

The hydro-treated liquid mentioned above was charged to the apparatus in a rate of 6.5 kg/hr, and was heat-treated at a disk rotating rate of 800 rpm, at a nitrogen feed rate of 80 l (as converted to the volume at room temperature)/min, under normal pressure, and at a temperature of 445° C., and the mesophase pitch was discharged continuously from the bottom of the apparatus by a gear pump. The yield of the mesophase pitch based on the refined heavy component was 16.3%, and the properties were as follows: Mettler method softening point: 306° C.; xylene insolubles: 94.7%; quinoline insolubles: 0.5%; pyridine insolubles: 37.3%, and mesophase content: nearly 100%.

The mesophase pitch was spun by using the spinning apparatus as used in Example 1 at a temperature of 335° C. and winding rate of 700 m/min, and the spun fiber was rendered infusible under the same condition as used in Example 1 and the fiber was carbonized at 1,000° C. Characteristics of the carbon fiber were as follows: Tensile strength 318 kg/mm$^2$; modulus of elasticity: 17.5 ton/mm$^2$. Further, the carbon fiber was graphitized at 2,500° C. The characteristics of the graphite fiber thus obtained were as follows: Tensile strength: 430 kg/mm$^2$; modulus of elasticity: 61.4 ton/mm$^2$,

TABLE 10

| | Heavy Coal Tar | Refined Heavy Component |
|---|---|---|
| Specific gravity | 1.206 | 1.203 |
| Viscosity (cSt, 100° C.) | 74.7 | 59.4 |
| Xylene insolubles (wt %) | 6.1 | 0.9 |
| Quinoline insolubles (wt %) | 0.6 | less than 0.1 |
| Distillation (°C.) | | |
| IBP | 272 | 267 |
| 10 vol % | 323 | 304 |
| 30 vol % | 363 | 346 |
| 50 vol % | 414 | 394 |

TABLE 11

| | Thermal-Cracked Heavy Component (second step) | Soluble Component (fourth step) |
|---|---|---|
| Specific gravity | 1.233 | 1.220 |
| Viscosity (cSt, 100° C.) | 119.5 | 46.4 |
| Xylene insolubles (wt %) | 10.5 | 1.8 |
| Quinoline insolubles (wt %) | less than 0.1 | less than 0.1 |
| Distillation (°C.) | | |
| IBP | 275 | 280 |
| 10 vol % | 338 | 328 |
| 30 vol % | 377 | 365 |
| 50 vol % | 440 | 414 |

EXAMPLE 6

The refined heavy component obtained in Example 5 was used as the starting raw material. By using the refined heavy component, the first step, i.e., a heat treatment; the second step, i.e., removal of light fractions by distillation; third step, i.e., separation of insoluble component newly formed and mother liquor; and the fourth step, i.e., recovery of soluble component from the mother liquor by removal of solvent with distillation, were continuously conducted. The treatments above were conducted in the same conditions as described in Example 5 except that the mixing ratio of xylene solvent and the thermal-cracked heavy component was changed to 2 parts of xylene/1 part of the thermal-cracked heavy component.

The insoluble component containing some amounts of xylene obtained in the third step per se, i.e., without subjecting the treatment for xylene removal, was blended with 1.6 times amounts of a hydrogenated anthracene oil (1.6 parts of the hydrogenated anthracene oil/1 part of the insoluble component) and then xylene was removed by distilling the mixture. A hydrogenation treatment was conducted by heat-treating the mixture thus obtained by using the same conditions and the same apparatus as those used in Example 2. The hydrotreated liquid thus obtained was heat-treated continuously in the continuous dispersion-heat-treating apparatus used in Example 5, thereby obtained a mesophase pitch for the production of high-performance carbon fibers. The heat treatment was conducted continuously under the same conditions as used in Example 5 except that the heat-treating temperature employed was 455° C.

Yield of the mesophase pitch thus obtained based on the refined heavy component was 17.8%. The mesophase pitch had following properties: Mettler method softening point: 308° C.; xylene insolubles: 94.7%; quinoline insolubles: 0.7%; mesophase content nearly 100%.

A carbon fiber was prepared from the mesophase pitch through spinning and infusion, followed by carbonization at 1,000° C. under the same conditions as in Example 5. Characteristics of the carbon fiber as measured were: Tensile strength: 309 kg/mm$^2$; modulus of elasticity: 18.5 ton/mm$^2$.

EXAMPLE 7

The refined heavy component obtained in Example 1 was used as the starting raw material. By using the refined heavy component, the first step, i.e., a heat treatment in a first tubular heater; the second step, i.e., removal of light fractions by distillation; the third step, i.e., separation of the insoluble component newly formed and mother liquor, and washing of the insoluble component; and the fourth step, i.e., recovery of soluble component from the mother liquor by removal of solvent with distillation, were continuously conducted in accordance with the process as illustrated in FIG. 2. The soluble component obtained in the fourth step was recirculated into the first tubular heater of the first step in a rate so as to give the soluble component/the refined heavy component weight ratio of 3/1. Further, to 1 part of the combined feed of fresh feed (refined heavy component) and soluble component recycled, 0.5 part of a wash oil was added. The wash oil had specific gravity of 1.053, 10 vol % boiling point of 245° C. and 90 vol % boiling point of 277° C. The wash oil was obtained from coal tar by distillation. The wash oil added in the first step was removed in the flash distillation column used in the second step. Yield of the thermal-cracked heavy component obtained in the second step based on the refined heavy component was 101%. The value, 101%, showed that the wash oil added was partly remained in the thermal-cracked heavy component.

The operating conditions of each step were set as follows:

| | |
|---|---|
| First step | |
| Amount of the feed | |
| Refined heavy component: | 3.0 kg/hr |
| Recycled amount of soluble component: | 9.0 kg/hr |
| Recycle ratio: | 3 |
| Wash oil (diluent) | 6.0 kg/hr |
| Tubular heater | |
| A heating tube with internal diameter of 6 mm and length of 40 m dipped in a molten salt bath. | |
| Heating tube outlet temperature: | 510° C. |
| Heating tube outlet pressure: | 20 Kg/cm$^2$G |
| Second step | |
| Distillation column | |
| Flasher | |
| Temperature: | 280° C. |
| Pressure: | Normal pressure |
| Third step | |
| Solvent: | Xylene |
| Solvent ratio: | 2 parts/1 part of thermal-cracked heavy component obtained in the second step (bottom fraction of the flasher) |
| Method for mixing of solvent and the thermal-cracked heavy component: | Into a pipe in which thermal-cracked heavy component flows at a temperature of about 100° C. under normal pressure, 2 times of xylene (based on the amount of the thermal-cracked heavy component) was continuously added and then cooled to room temperature by a cooler. |

-continued

| | |
|---|---|
| Separation and recovery of the insoluble component | |
| Separator: | Centrifuge (Mini-Decanter manufactured by Ishikawajima Harima Heavy Industries, Ltd.) |
| Conditions: | Room temperature, normal pressure |
| Washing of insoluble component | |
| One (1) part of the insoluble component obtained from the centrifuge was added, mixed and dispersed into 2 parts of xylene at room temperature, and then filtered under pressure. | |
| Fourth step | |
| Solvent recovery column | |
| Packed column | |
| Temperature: | 145° C. |
| Pressure: | Normal pressure |

The yield based on refined heavy component of high-molecular-weight bituminous material obtained from the insoluble component with removal of xylene by heating under a reduced pressure was 19.9%. The high-molecular-weight bituminous material had following properties: Xylene insolubles: 73.5%; quinoline insolubles: 0.1%. When observed by a polarizing microscope, it showed isotropy in its entirety. During this operation, samples were taken from each step and analyzed. The results were shown in Table 12.

Then, 3 parts of a hydrogenated anthracene oil was added to 1 part of the high-molecular-weight bituminous material to dissolution and then the mixture was heat-treated using the same conditions and the tubular heater as used in Example 5 to conduct hydrogenation, and a hydro-treated liquid was obtained. The hydro-treated liquid was heat-treated by using the continuous dispersion-heat-treating apparatus with the construction as described in Example 5. Conditions used in the heat treatment were identical with those used in Example 5, except that heat-treating temperature was changed to 449° C. Thus, a mesophase pitch was obtained.

Yield of the mesophase pitch based on the refined heavy component was 11.9%. The mesophase pitch had following properties: Mettler method softening point: 300° C.; xylene insolubles: 92.8%; quinoline insolubles: 0.6%; pyridine insolubles: 38.0%. When observed by a polarizing microscope, the mesophase pitch showed a mesophase content of nearly 100%.

The mesophase pitch was spun into a fiber by using the spinning apparatus as used in Example 1 at a temperature of 325° C. and winding speed of 700 m/min, and the spun fiber was rendered infusible under the same condition as used in Example 1 and the fiber was carbonized at 1,000° C. Characteristics of the carbon fiber were as follows: Tensile strength: 328 kg/mm$^2$; modulus of elasticity: 16.6 ton/mm$^2$.

TABLE 12

| | Thermal-Cracked Heavy Component (second step) | Soluble Component (fourth step) |
|---|---|---|
| Specific gravity | 1.195 | 1.188 |
| Viscosity (cSt, 100° C.) | 23.8 | 19.0 |
| Xylene insolubles (wt %) | 6.1 | 2.1 |
| Quinoline insolubles (wt %) | less than 0.1 | less than 0.1 |
| Distillation (°C.) | | |
| IBP | 222 | 219 |
| 10 vol % | 253 | 250 |
| 30 vol % | 345 | 342 |
| 50 vol % | 427 | 405 |

EXAMPLE 8

The first through fourth steps operation was carried out by using the same refined heavy component and under the same operating conditions as in Example 2, except that a temperature of 520° C. was employed in heat treatment in the tubular heater in the first step. The recycling of the material from the fourth step into the first step was also performed in the same manner as in Example 2, thus obtaining a solvent-insoluble component from the third step. Washing of this insoluble component by dispersing it into two times amount of xylene, followed by centrifugation, was repeated twice. A high-molecular-weight bituminous material was obtained from the insoluble component thus produced after removing xylene by heating under a reduced pressure. This high-molecular-weight bituminous material contained 83.5% of xylene-insoluble component and 0.2% of quinoline-insoluble component, with the yield based on the refined heavy component being 38.9%.

This high-molecular-weight bituminous material was continuously hydrogenated and heat-treated in the same way as described in the portion relative to batchwise mesophase pitch production of Example 2 to obtain a spinning pitch with a Mettler method softening point of 303° C. The yield of the hydrogenated pitch based on the high-molecular-weight bituminous material was 94.6% and that of the spinning pitch (mesophase pitch) based on the hydrogenated pitch was 76%. This spinning pitch had following properties: Mesophase content; nearly 100%; quinoline insolubles: 4.7%; and xylene solubles: 5.3%. A carbon fiber was prepared using this spinning pitch through spinning, infusion, carbonization, and graphitization in the same manner as in Example 1. Characteristics of the carbon fiber are shown in Table 13.

TABLE 13

| The Characteristics of Carbon Fiber and Graphite Fiber | Carbonized at 1,000° C. | Graphitized at 2,500° C. |
|---|---|---|
| Fiber diameter ($\mu$) | 6.5 | 5.7 |
| Tensile strength (kg/mm$^2$) | 359 | 462 |
| Elongation at break (%) | 2.01 | 0.70 |
| Modulus of elasticity (ton/mm$^2$) | 17.8 | 66.2 |

EXAMPLE 9

The refined heavy component obtained in Example 1 was used as the starting raw material. One weight part of this refined heavy component and 1 weight part of a wash oil were charged by different pumps to the first continuous tubular heater with an inner diameter of 6 mm and a length of 40 m, and the mixture was heated at 510° C. under a pressure of 20 Kg/cm$^2$G, and with a residence time of 228 sec. The product was immediately sent to the first distillation column and was distilled at 480° C. under atmospheric pressure to give a pitch with a softening point of 156° C., quinoline insoluble contents of 0.2%, and xylene insoluble contents of 59%, in a yield of 28.6% based on the refined heavy component. One weight part of this pitch and 2 weight parts of a hydrogenated anthracene oil were mixed and the resulting solution was pumped into the second continuous tubular heater with an inner diameter of 8 mm and a length of 60 m, and was heated at 440° C. under a pressure of 50 Kg/cm²G, and with a residence time of 86 min. Thus, a hydro-treated liquid was obtained.

A mesophase pitch was prepared from the hydro treated liquid thus obtained by a heat treatment in the continuous dispersion-heat-treating apparatus used in Example 5.

The heat treatment was conducted at a hydro-treated liquid feed rate of 6.5 kg/hr, a disk rotating rate of 800 rpm, a nitrogen gas blowing rate of 200 l/min, a temperature of 480° C. and under normal pressure.

The heat treatment was carried out continuously. The mesophase pitch thus obtained had following properties: Mettler method softening point: 319° C.; xylene insolubles: 92.9%; quinoline insolubles: 9.5%; mesophase content: about 80%.

A pitch fiber was spun from the mesophase pitch by using the spinning apparatus used in Example 1 at a temperature of 341° C. and at a winding rate of 600 m/min. The pitch fiber was rendered infusible under the same condition as used in Example 1 and was carbonized at 1,000° C., thereby obtained a carbon fiber with characteristics of a tensile strength of 251 kg/mm² and a modulus of elasticity of 13.2 ton/mm².

EXAMPLE 10

A naphtha tar having a specific gravity of 1.0652 and xylene insoluble content of 0 wt % was heat-treated in a tubular heater at a temperature of 460° C., pressure of 20 Kg/cm²G, and residence time of 210 sec, and was immediately cooled. The thermal-cracked heavy component thus obtained was used for as the raw material for the treatment by the process of the present invention.

The same apparatus was used as that used in Example 1. Continuous runs were conducted under the conditions of a raw material feed rate of 7.0 kg/hr, a nitrogen feed rate of 30 l/min, and a disk rotating rate of 700 rpm, with a 5-disk-collecting pan combination. The treating temperature was changed within the range of 400°–460° C. for each run. The treating temperature used and the properties of the pitches obtained are shown in Table 14.

All pitches obtained in this Example exhibited complete isotropy when observed by a polarizing microscope.

TABLE 14

| Experiments No. | 21 | 22 | 23 | 24 |
|---|---|---|---|---|
| Treating temperature (°C.) | 400 | 420 | 430 | 440 |
| Yield of pitch (wt %) | 20.9 | 18.9 | 17.3 | 15.7 |
| Properties of pitch | | | | |
| Mettler method softening point (°C.) | 243 | 270 | 282 | 294 |
| Xylene insolubles (wt %) | 27.0 | 42.3 | 48.8 | 55.2 |
| Quinoline insolubles (wt %) | less than 0.1 | less than 0.1 | less than 0.1 | less than 0.1 |

We claim:

1. A process for preparing a mesophase pitch for the production of high-performance carbon fibers which comprises A. a first continuous step of heat-treating a combined feed consisting of a. a heavy oil or pitch of coal or petroleum origin which is substantially free from a material insoluble in a monocyclic aromatic hydrocarbon solvent, and b. the component substantially soluble in the monocyclic aromatic hydrocarbon solvent which is recycled from the fourth continuous step hereinafter described, in a tubular heater under an increased pressure at a temperature of 400°–600° C., thus producing 3–50 wt % of xylene-insoluble component in the heat-treated material without substantially producing a quinoline-insoluble component, B. a second continuous step of distilling or flashing said heat-treated material obtained in the first step at a temperature below 350° C. under normal pressure, or at equivalent conditions, to remove a portion of light fractions, thus obtaining a thermal-cracked heavy component, C. a third continuous step of adding to said thermal-cracked heavy component 1–5 times by weight of a monocyclic aromatic hydrocarbon solvent or other solvent having the same degree of dissolving ability with the monocyclic aromatic hydrocarbon solvent and separating and collecting an insoluble component to obtain a high-molecular-weight bituminous material, D. a fourth continuous step of removing the solvent from the mother liquor which has been obtained from the mixture of the solvent and the thermal-cracked heavy component by removing the insoluble component contained therein in the third step, thus obtaining a component substantially soluble in said monocyclic aromatic hydrocarbon solvent, recycling whole or a portion of said component substantially soluble in said monocyclic aromatic hydrocarbon solvent to the first step, E. a fifth step of hydrogenating said high-molecular-weight bituminous material obtained in said third step by heat-treating the same in the presence of a hydrogen-donating solvent and removing said hydrogen-donating solvent to obtain a substantially optically isotropic hydrogenating pitch, and F. a sixth step of heat-treating said substantially isotropic hydrogenated pitch under the conditions of a reduced or normal pressure and a temperature of 350°–500° C. while flowing an inert gas or a superheated vapor, thereby converting said hydrogenated pitch into a mesophase pitch.

2. The process as defined in claim 1, wherein said combined feed used as the raw material contains 10–70% by weight of an aromatic oil having a boiling range of within 200°–350° C. which does not substantially produce a component insoluble in a monocyclic aromatic hydrocarbon solvent in said heat treatment within the tubular heater.

3. The process as claimed in claim 1, wherein the first continuous step is conducted in the addition of not more than equivalent amount by weight of an aromatic oil to the amount of said combined feed, said aromatic oil has a boiling range of within 200°–350° C. and does not substantially produce a component insoluble in a monocyclic aromatic hydrocarbon solvent in said heat treatment within the tubular heater.

4. The process as claimed in claim 1, wherein said heat treatment using a tubular heater in said first step is carried out under the conditions of a temperature of 400°–600° C. and pressure of 1–100 Kg/cm²G at the outlet of said tubular heater.

5. The process as claimed in claim 4, wherein said temperature is 450°–550° C. and said pressure is 2–50 Kg/cm²G.

6. The process as claimed in claim 1, wherein the amount of said component substantially soluble in the monocyclic aromatic hydrocarbon solvent produced in the fourth step to be recycled to the first step is equivalent or more by weight of the amount of the heavy oil or pitch.

7. The process as claimed in claim 6, wherein said amount to be recycled is 2-6 times the amount by weight of said raw material.

8. The process as claimed in claim 1, wherein said fifth step is carried out continuously using a tubular heater in the presence of a hydrogen-donating solvent of 1-5 times by weight of said high-molecular-weight bituminous material under the conditions of a temperature of 350°-500° C. and pressure of 20-100 $Kg/cm^2G$, and the hydro-treated liquid thus obtained is subjected to distillation using a distillation column under the conditions of a pressure of 0-3 $Kg/cm^2A$ and temperature of 300°-530° C., thus continuously obtaining a hydrogenated pitch from the bottom of said distillation column.

9. The process as claimed in claim 1, wherein said monocyclic aromatic hydrocarbon solvent is at least one selected from the group consisting of benzene, toluene, and xylene.

10. The process as claimed in claim 1, wherein said solvent used in said third step is a monocyclic aromatic hydrocarbon solvent.

11. The process as claimed in claim 1, wherein said heavy oil or pitch charged to said first step as a raw material and said thermal-cracked heavy component obtained in said second step contain at least 10 wt % of a light fraction having a boiling range of within 200°-350° C., and have a viscosity of not more than 1,000 cSt at 100° C.

12. The process as claimed in claim 1, wherein said high-molecular-weight bituminous material obtained in said third step contains not more than 1 wt % of quinoline-insoluble component and at least 40 wt % of xylene-insoluble component, and is a substantially optically isotropic high-molecular-weight bituminous material.

13. The process as defined in claim 1, wherein said hydrogenated pitch is a substantially optically isotropic, has a softening point measured by the Ring and Ball method of 100°-200° C., and contains not more than 1 wt % of quinoline-insoluble component and at least 40 wt % of xylene-insoluble component.

14. The process as claimed in claim 1, wherein said mesophase pitch has characteristics of a Mettler method softening point of below 310° C., mesophase content of not less than 90% in terms of the area percentage of the portion exhibiting optical anisotropy when observed by a polarizing microscope, and of not more than 10 wt % of quinoline-insoluble content, not more than 10 wt % of xylene-soluble content and not less than 25 wt % of pyridine-insoluble content.

15. A process for preparing a mesophase pitch for the production of high-performance carbon fibers which comprises A. a first continuous step of heat-treating a combined feed consisting of
   a. a heavy oil or pitch of coal or petroleum origin which is substantially free form a material insoluble in a monocyclic aromatic hydrocarbon solvent, and
   b. the component substantially soluble in the monocyclic aromatic hydrocarbon solvent which is recycled form the fourth continuous step hereinafter described in a tubular heater under an increased pressure at a temperature of 400°-600° C., thus producing 3-30 wt % of xylene-insoluble component in the heat-treated material without substantially producing a quinoline-insoluble component, B. a second continuous step of distilling or flashing said heat-treated material obtained in the first step at a temperature below 350° C. under normal pressure, or at equivalent conditions, to remove a portion of light fractions, thus obtaining a thermal-cracked heavy component, C. a third continuous step of adding to said thermal-cracked heavy component 1-5 times by weight of a monocyclic aromatic hydrocarbon solvent or other solvent having the same degree of dissolving ability with the monocyclic aromatic hydrocarbon solvent, and separating and collecting an insoluble component to obtain a high-molecular-weight bituminous material, D. a fourth continuous step of removing the solvent from the mother liquor which has been obtained from the mixture of the solvent and the thermal-cracked heavy component by removing the insoluble component contained therein in the third step, thus obtaining a component substantially soluble in said monocyclic aromatic hydrocarbon solvent, recycling whole or a portion of said component substantially soluble in said monocyclic aromatic hydrocarbon solvent to the first step, E. a fifth step of hydrogenating said high-molecular-weight bituminous material obtained in said third step by heat-treating the same in the presence of a hydrogen-donating solvent, thereby obtaining a hydro-treated liquid, or further removing said hydrogen-donating solvent from said hydro-treated liquid to obtain a substantially optically isotropic hydrogenated pitch, and F. a sixth step of heat-treating said hydro-treated liquid or hydrogenated pitch by dispersing it by centrifugal force generated by a rotating structure in a gas stream of an inert gas or super-heated vapor as fine oil droplets at 350°-500° C. under a reduced or normal pressure, and bringing the dispersed fine oil droplets into contact with the inert gas or super-heated vapor, collecting said dispersed fine droplets and repeating said dispersing and collecting operations at least once more under the same condition as above, thereby converting said hydro-treated liquid or hydrogenated pitch into a mesophase pitch.

16. The process as claimed in claim 15, wherein said combined feed used as the raw material contains 10-70% by weight of an aromatic oil having a boiling range of within 200°-350° C. which does not substantially produce a component insoluble in a monocyclic aromatic hydrocarbon solvent in said heat treatment within the tubular heater.

17. The process as claimed in claim 15, wherein the first continuous step is conducted in the addition of not more than equivalent amount by weight of an aromatic oil to the amount of said combined feed, said aromatic oil has a boiling range of within 200°-350° C. and does not substantially produce a component insoluble in a monocyclic aromatic hydrocarbon solvent in said heat treatment within the tubular heater.

18. The process as claimed in claim 15, wherein said heat treatment using a tubular heater in said first step is carried out under the conditions of a temperature of 400°-600° C. and pressure of 1-100 Kg/cm$^2$G at the outlet of said tubular heater.

19. The process as claimed in claim 18, wherein said temperature is 450°-550° C. and said pressure is 2-50 Kg/cm$^2$G.

20. The process as claimed in claim 15, wherein the amount of said component substantially soluble in the monocyclic aromatic hydrocarbon solvent produced in the fourth step to be recycled to the first step is equivalent or more by weight of the amount of the heavy oil or pitch.

21. The process as claimed in claim 20, wherein said amount to be recycled is 2-6 times the amount by weight of said raw material.

22. The process as claimed in claim 15, wherein said fifth step is carried out continuously using a tubular heater in the presence of a hydrogen-donating solvent of 1-5 times by weight of said high-molecular-weight bituminous material under the conditions of a temperature of 350°-500° C. and pressure of 20-100 Kg/cm$^2$G, thus continuously obtaining a hydro-treated liquid.

23. The process as claimed in claim 15, wherein said fifth step is carried out continuously using a tubular heater int eh presence of a hydrogen-donating solvent of 1-5 times by weight of said high molecular-weight bituminous material under the conditions of a temperature of 350°-500° C. and pressure of 20-100 Kg/cm$^2$G, and the hydro-treated liquid thus obtained is subjected to distillation using a distillation column under the conditions of a pressure of 0-3 Kg/cm$^2$A and temperature of 300°-530° C., thus continuously obtaining a hydrogenated pitch form the bottom of said distillation column.

24. The process as claimed in claim 15, wherein said monocyclic aromatic hydrocarbon solvent is at least one selected from the group consisting of benzene, toluene, and xylene.

25. The process as claimed in claim 15, wherein said solvent used in said third step is a monocyclic aromatic hydrocarbon solvent.

26. The process as claimed in claim 15, wherein said heavy oil or pitch charged to said first step as a raw material and said thermal-cracked heavy component obtained in said second step contain at least 10 wt % of a light fraction having a boiling range of within 200°-350° C., and have a viscosity of not more than 1,000 cSt at 100° C.

27. The process as claimed in claim 15, wherein said high-molecular weight bituminous material obtained in said third step contains not more than 1 wt % of quinoline-insoluble component and at least 40 wt % of xylene-insoluble component, and is a substantially optically isotropic high-molecular-weight bituminous material.

28. The process as claimed in claim 15, wherein said hydrogenated pitch is a substantially optically isotropic, has a softening point measured by the Ring and Ball method of 100°-200° C., and contains not more than 1 wt % of quinoline-insoluble component and at least 40 wt % of xylene-insoluble component.

29. The process as claimed in claim 15, wherein said mesophase pitch has characteristics of a Mettler method softening point of below 310° C., mesophase content of not less than 90% in terms of the area percentage of the portion exhibiting optical anisotropy when observed by a polarizing microscope, and of not more than 10 wt % of quinoline-insoluble content, not more than 10 wt % of xylene-soluble content and not less than 25 wt % of pyridine-insoluble content.

* * * * *